US009442415B2

(12) United States Patent
Funatsu

(10) Patent No.: US 9,442,415 B2
(45) Date of Patent: Sep. 13, 2016

(54) IMAGE FORMATION APPARATUS WITH INITIAL VOLTAGE POLARITY SETTING

(71) Applicant: Oki Data Corporation, Tokyo (JP)

(72) Inventor: Kenichi Funatsu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/886,506

(22) Filed: Oct. 19, 2015

(65) Prior Publication Data

US 2016/0223936 A1 Aug. 4, 2016

(30) Foreign Application Priority Data

Jan. 30, 2015 (JP) ..... 2015-016723

(51) Int. Cl.
*G03G 15/06* (2006.01)

(52) U.S. Cl.
CPC ..... *G03G 15/065* (2013.01)

(58) Field of Classification Search
CPC ..... G03G 15/065; G03G 15/0806
USPC ..... 399/55
See application file for complete search history.

(56) References Cited

FOREIGN PATENT DOCUMENTS

JP H10-105016 A 4/1998

*Primary Examiner* — William J Royer
(74) *Attorney, Agent, or Firm* — Mots Law, PLLC

(57) ABSTRACT

An image formation apparatus includes an image carrier; a charge member; an exposure unit; a development member; a measurement unit that measures a stop time period when a rotation of the image carrier is being stopped, or a physical amount that varies as the stop time period increases; a setting unit that sets a polarity of an initial voltage to be applied to the development member, the polarity being determined based on the stop time period or the physical amount measured by the measurement unit; and a power source unit that applies the initial voltage with the polarity set by the setting unit to the development member, at rotation start time of the image carrier.

11 Claims, 14 Drawing Sheets

120 DEVELOPMENT VOLTAGE TABLE

| $T_{off}$ | $V_{34}$ |
|---|---|
| t1 | Va |
| t2 | Va |
| t3 | Vb |
| ⋮ | ⋮ |
| tn | Vb |

$V_{31} < Va < 0volt$ $Vb > 0volt$

130 DEVELOPMENT VOLTAGE FUNCTION $V_{34}=f_1(T_{off})$

140 POLAR TABLE

| $T_{off}$ | POLARITY $P_{34}$ OF $V_{34}$ |
|---|---|
| t1 | - |
| t2 | - |
| t3 | + |
| ⋮ | ⋮ |
| tn | + |

150 POLAR FUNCTION

POLARITY $P_{34}$ OF $V_{34}=f_2(T_{off})$

FIG. 15A

| $T_{60}$ | $V_{34}$ |
|---|---|
| Tf1 | Va |
| Tf2 | Va |
| Tf3 | Vb |
| ⋮ | ⋮ |
| Tfn | Vb |

160 DEVELOPMENT VOLTAGE TABLE

FIG. 15B $V_{34}=f_3(T_{60})$

170 DEVELOPMENT VOLTAGE FUNCTION

FIG. 16A

| $T_{60}$ | POLARITY $P_{34}$ OF $V_{34}$ |
|---|---|
| Tf1 | − |
| Tf2 | − |
| Tf3 | + |
| ⋮ | ⋮ |
| Tfn | + |

180 POLAR TABLE

FIG. 16B

POLARITY $P_{34}$ OF $V_{34}=f_4(T_{60})$

190 POLAR FUNCTION

FIG. 17A

| $V_{31}$ | $V_{34}$ |
|---|---|
| V1 | Va |
| V2 | Va |
| V3 | Vb |
| ⋮ | ⋮ |
| Vn | Vb |

210 DEVELOPMENT VOLTAGE TABLE

FIG. 17B

220 DEVELOPMENT VOLTAGE FUNCTION $V_{34} = f_5(T_{31})$

IMAGE FORMATION APPARATUS WITH INITIAL VOLTAGE POLARITY SETTING

CROSS REFERENCE TO RELATED APPLICATIONS

This application claims priority based on 35 USC 119 from prior Japanese Patent Application No. 2015-016723 filed on Jan. 30, 2015, entitled "IMAGE FORMATION APPARATUS", the entire contents of which are incorporated herein by reference.

BACKGROUND OF THE INVENTION

1. Field of the Invention

The disclosure relates to an electrophotographic image formation apparatus.

2. Description of Related Art

In electrophotographic image formation apparatuses, the surface voltage of a photosensitive drum is close to 0 volt immediately after a power supply is turned on or when a development unit is started up after a long standby state. When a normal development process is executed in that state, a negative voltage is applied to a development roller to negatively charge a developer on the development roller. In this process, a potential difference between the photosensitive drum and the development roller is generated, so that the negatively charged developer on the development roller is attracted to the photosensitive drum and consequently is wastefully consumed. To cope with this situation, for example, Japanese Patent Application Publication No. 10-105016 discloses a technology of preventing a developer from being attracted to a photosensitive drum by applying a positive voltage to a development roller until a region of a peripheral surface of the photosensitive drum, where the surface voltage of the photosensitive drum is close to 0 volt, finishes passing the development roller.

SUMMARY OF THE INVENTION

In an image formation apparatus disclosed in Japanese Patent Application Publication No. 10-105016, there is a case where an operation such as printing is ended and the photosensitive drum is temporarily stopped, and immediately after the temporal stop, an operation such as printing is started again. In such a case, the photosensitive drum sometimes starts to rotate before the surface voltage of the photosensitive drum is attenuated. If a positive voltage is applied to the development roller in that condition, a developer positively charged on the development roller is strongly attracted to the surface of the negatively charged photosensitive drum, and is consequently wastefully consumed.

An object of an embodiment of the invention is to provide an image formation apparatus capable of reducing the wasteful consumption of a developer.

An aspect of the invention is an image formation apparatus that includes: an image carrier including a peripheral surface with a photosensitive element; a charge member placed facing the peripheral surface and configured to charge the peripheral surface; an exposure unit that exposes a charged region of the peripheral surface charged by the charge member with light to form an electrostatic latent image; a development member placed facing the peripheral surface at a position downstream of the charge member in a rotation direction of the image carrier, and configured to develop the electrostatic latent image with a developer; a measurement unit that measures a stop time period when a rotation of the image carrier is being stopped, or a physical amount that varies as the stop time period increases; a setting unit that sets a polarity of an initial voltage to be applied to the development member, the polarity determined based on the stop time period or on the physical amount measured by the measurement unit; and a power source unit that applies the initial voltage with the polarity set by the setting unit to the development member, at rotation start time of the image carrier.

According to the aspect of the invention, the wasteful consumption of the developer can be reduced.

BRIEF DESCRIPTION OF THE DRAWINGS

FIG. 15A is a diagram illustrating an example of a development voltage table;

FIG. 15B is a diagram illustrating an example of a development voltage function;

FIG. 16A is a diagram illustrating an example of a polar table;

FIG. 16B is a diagram illustrating an example of a polar function;

FIG. 17A is a diagram illustrating an example of a development voltage table; and FIG. 17B is a diagram illustrating an example of a development voltage function.

DETAILED DESCRIPTION OF EMBODIMENTS

Figure 1:
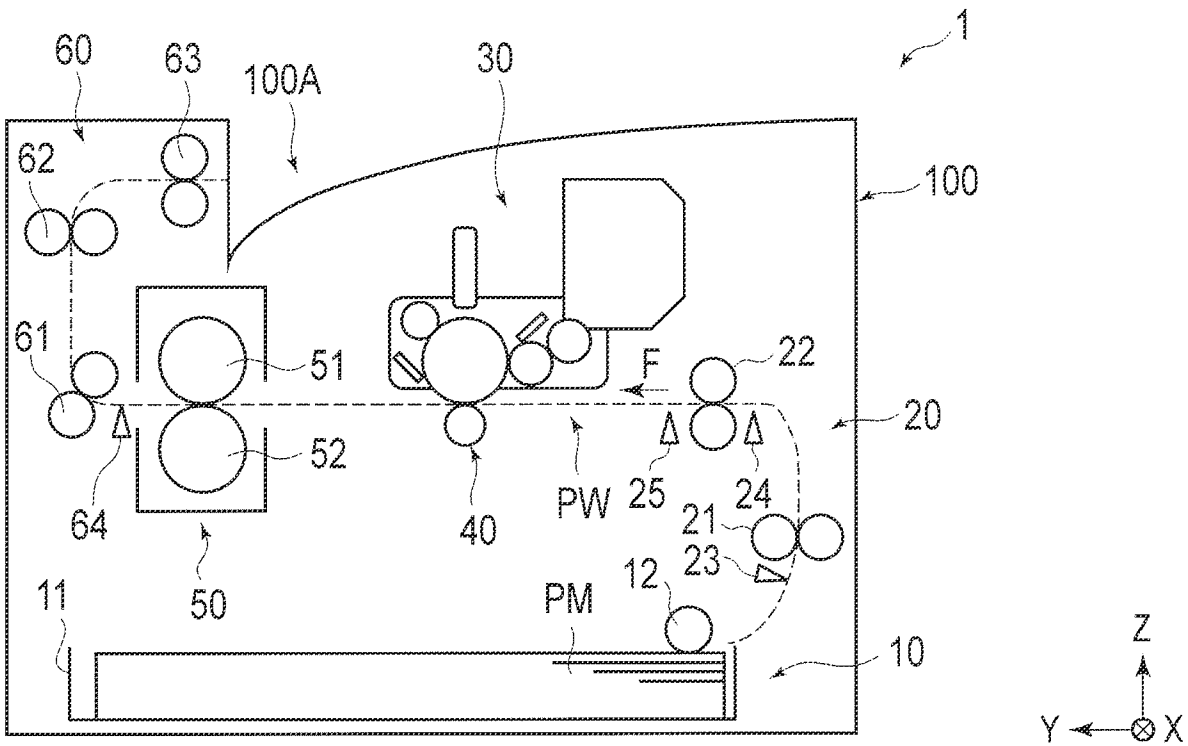
FIG. 1 is a schematic diagram illustrating a schematic configuration example of an image formation apparatus according to one embodiment of the invention.

Descriptions are provided hereinbelow for embodiments based on the drawings. In the respective drawings referenced herein, the same constituents are designated by the same reference numerals and a duplicate explanation concerning the same constituents is omitted. All of the drawings are provided to illustrate the respective examples only.

Hereinafter, embodiments of the invention are described in detail with reference to the drawings. The following explanation is merely one specific example of the invention, and the invention is not limited to the aspects below. Moreover, in the invention, placements, sizes, ratios of the sizes, and the like, of respective components are not limited to those illustrated in the drawings. The explanation is made in the following order.

1. Embodiment

An example in which the polarity of a development roller is set based on a stop time period.

2. Modification Examples

First modification example: another example in which the polarity of the development roller is set based on a stop time period.

Second modification example: an example in which the polarity of the development roller is set based on the temperature of a fixation unit.

Third modification example: another example in which the polarity of the development roller is set based on the temperature of the fixation unit.

Fourth modification example: an example in which the polarity of the development roller is set based on the surface voltage of a photosensitive drum.

Fifth modification example: an example in which the polarity of the development roller is set based on the environment in a housing.

Sixth modification example: various kinds of modification examples.

<1. Embodiment>

[Configuration]

FIG. 1 schematically illustrates a schematic configuration example of image formation apparatus 1 according to one embodiment of the invention. Image formation apparatus 1 is a printer that forms an image on medium PM using an electrophotographic system. Media PM are, for example, single-cut sheets. Image formation apparatus 1 is provided with paper feed unit 10, conveyance unit 20, image formation unit 30, transfer unit 40, fixation unit 50, and delivery unit 60. Paper feed unit 10, conveyance unit 20, image formation unit 30, transfer unit 40, fixation unit 50, and delivery unit 60 are provided inside housing 100.

In the description, a path along which medium PM is conveyed is called conveyance path PW. In conveyance path PW, "upstream in conveyance path PW" indicates a direction toward paper feed unit 10 from a given component or a position located closer to paper feed unit 10 than the given component is located. In conveyance path PW, "downstream of conveyance path PW" indicates a direction opposite to the direction toward paper feed unit 10 from a given component, or a position located farther from paper feed unit 10 than the given component is located. In conveyance path PW, conveyance direction F indicates a direction in which medium PM travels (in other words, a direction from the upstream of conveyance path PW toward the downstream of conveyance path PW).

(Configuration of Paper Feed Unit 10)

Paper feed unit 10 is configured to supply media PM one by one in conveyance path PW. Paper feed unit 10 includes, for example, paper feed tray 11 and pickup roller 12. Paper feed tray 11 contains media PM being stacked. Paper feed tray 11 is mounted to, for example, a lower portion of image formation apparatus 1 in an attachable and detachable manner. Pickup roller 12 supplies medium PM that is contained in paper feed tray 11 to conveyance unit 20. Pickup roller 12 performs a rotation operation in a direction to allow medium PM to be fed out onto conveyance path PW under the control of controller 101, which is described later in FIG. 3.

(Configuration of Conveyance Unit 20)

Conveyance unit 20 is configured to convey medium PM from paper feed unit 10 to transfer unit 40 along conveyance path PW while restricting any tilting of medium PM. Conveyance unit 20 is placed downstream of paper feed unit 10 in conveyance path PW. Conveyance unit 20 includes, for example, pairs of registration rollers 21 and 22, and sensors 23, 24, and 25.

Pair of registration rollers 21 is placed upstream of pair of registration rollers 22 in conveyance path PW, and specifically, is placed between paper feed tray 11 and pair of registration rollers 22. Pair of registration rollers 21 performs a contact process on medium PM that is conveyed through conveyance path PW, and thereafter conveys medium. PM in conveyance direction F along conveyance path PW. The contact process indicates a process to bring a leading edge of medium PM conveyed from paper feed unit 10 into contact with a pair of registration rollers 21 which stop rotating. While the contact process is performed, no power of motor 104 (which is described later in FIG. 3) that is controlled by controller 101 is transmitted to pair of registration rollers 21. In other words, pair of registration rollers 21 stops rotating while performing the contact process. Then, when conveying medium PM, pair of registration rollers 21 performs a rotation operation in a direction to convey medium PM in conveyance direction F under the control of controller 101. Sensor 23 is placed upstream of pair of registration rollers 21 in conveyance path PW. Sensor 23 detects a position of medium PM so as to adjust a drive timing of pair of registration rollers 21. Sensor 23 detects, for example, medium PM being conveyed along conveyance path PW.

Pair of registration rollers 22 is placed downstream of pair of registration rollers 21 in conveyance path PW, and is placed between sensor 24 and sensor 25, for example. Pair of registration rollers 22 conveys medium PM conveyed through conveyance path PW along conveyance path PW in conveyance direction F. Pair of registration rollers 22 performs a rotation operation to convey medium PM in conveyance direction F under the control of controller 101. Sensor 24 is placed upstream of pair of registration rollers 22 and sensor 25, in conveyance path PW. Sensor 24 detects a position of medium PM so as to adjust a drive timing of pair of registration rollers 22. Sensor 24 detects medium PM that is conveyed through conveyance path PW. Sensor 25 is placed downstream of sensor 24 in conveyance path PW. Sensor 25 detects a position of medium PM so as to adjust a timing for image formation in image formation unit 30. Sensor 25 detects medium PM that is conveyed through conveyance path PW.

(Configuration of Image Formation Unit 30)

Figure 2:
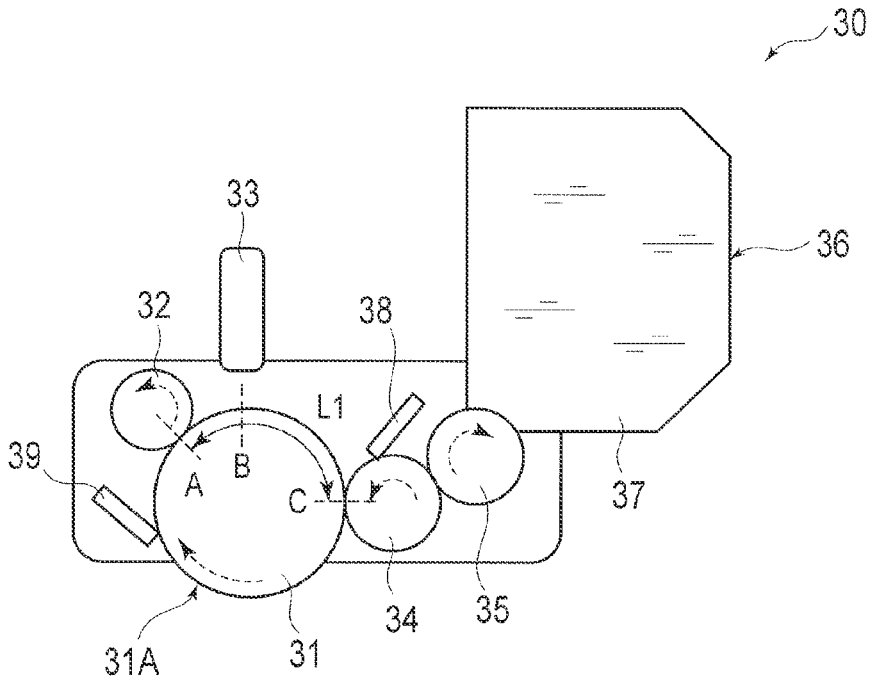
FIG. 2 is a schematic diagram illustrating a schematic configuration example of an image formation unit in FIG. 1.

FIG. 2 schematically illustrates a schematic configuration example of image formation unit 30. Image formation unit 30 is placed downstream of conveyance unit 20 in conveyance path PW. Image formation unit 30 is configured to form an image onto peripheral surface 31A of photosensitive drum 31, which is described later. Image formation unit 30 includes photosensitive drum 31, charge roller 32, light emitting diode (LED) head 33, development roller 34, supply roller 35, cartridge 36, regulation blade 38, and cleaning blade 39, for example, as illustrated in FIG. 2. Cartridge 36 is filled with developer 37. Photosensitive drum 31 corresponds to a specific example of a "photosensitive drum" of the invention. Peripheral surface 31A corresponds to a specific example of a "peripheral surface" of the invention. Charge roller 32 corresponds to a specific example of a "charge member" of the invention. LED head 33 corresponds to a specific example of an "exposure unit" of the invention. Development roller 34 corresponds to a specific example of a "development member" of the invention. Developer 37 corresponds to a specific example of "developer" of the invention.

Photosensitive drum 31 includes peripheral surface 31A with a photosensitive element (for example, an organic photosensitive element), and is a cylindrical member that can support an electrostatic latent image on peripheral surface 31A. Specifically, photosensitive drum 31 includes a conductive support, and a photoconductive layer that covers an outer circumference (surface) thereof. The conductive support is configured to include, for example, a metal pipe made of aluminum. The photoconductive layer includes a structure, for example, in which a charge generation layer and a charge transport layer are sequentially stacked. Photosensitive drum 31 performs a rotation operation to convey medium PM in conveyance direction F at a predetermined circumferential speed under the control of controller 101.

Charge roller 32 is a member (charge member) that charges peripheral surface 31A of photosensitive drum 31. Charge roller 32 is placed so as to come into contact with peripheral surface 31A of photosensitive drum 31, and is placed facing peripheral surface 31A at first point A. First point A corresponds to a point indicated as "A" in FIG. 2. Charge roller 32 includes, for example, a metal shaft made of stainless steel, and a semiconducting elastic layer (for example, a semiconducting epichlorohydrin rubber layer) that covers an outer circumference (surface) thereof. Charge roller 32 performs a rotation operation in a direction opposite to the direction of the rotation of photosensitive drum 31 by the transmission of a drive force from photosensitive drum 31, for example.

Figure 8:
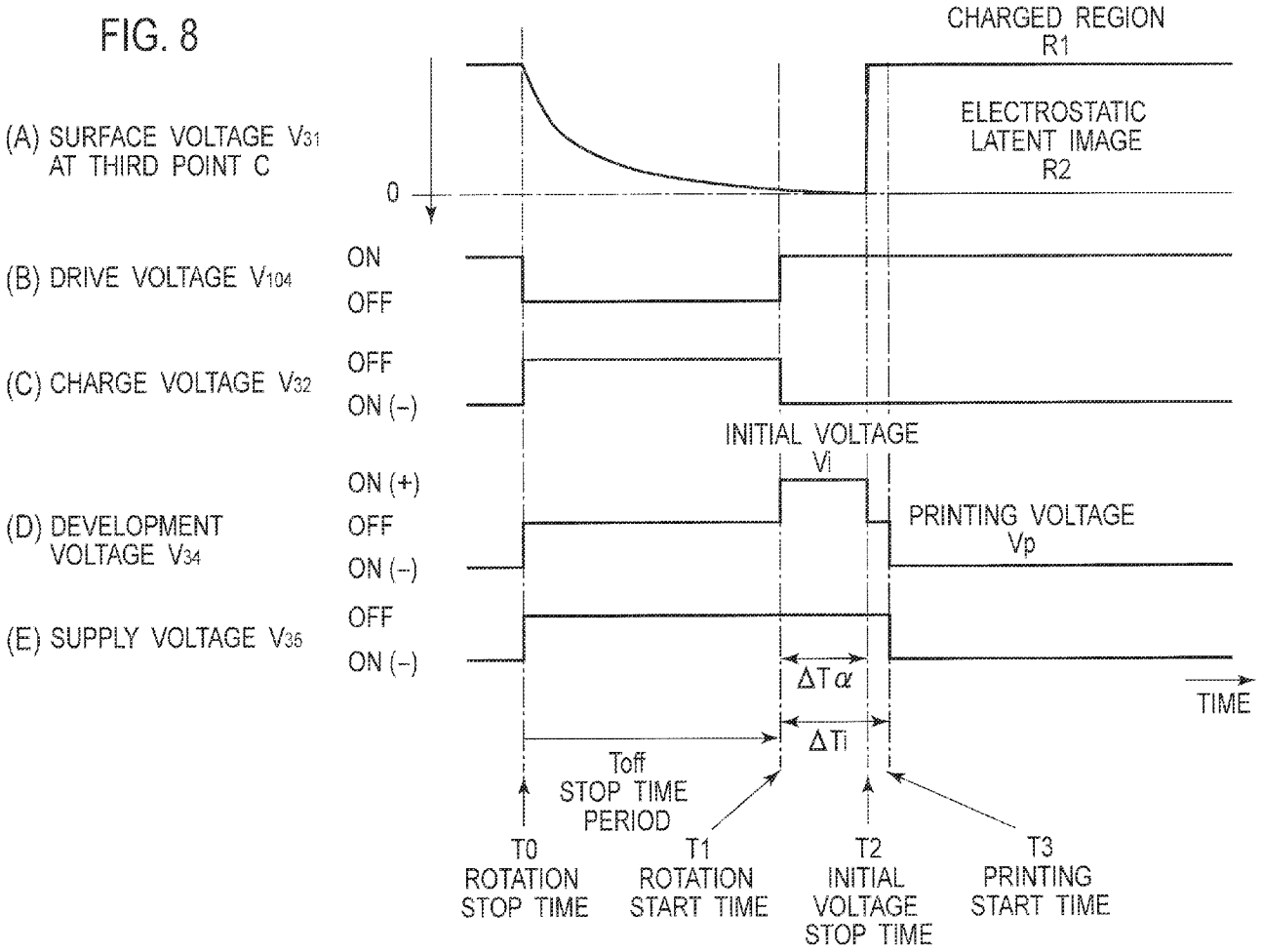
FIG. 8 shows waveform diagrams (A) to (E) illustrating examples of various kinds of waveforms in the image formation apparatus.

LED head 33 is an exposure device that exposes charged region R1 of peripheral surface 31A that is charged by charge roller 32 to light to form electrostatic latent image R2 in charged region R1 of peripheral surface 31A. Charged region R1 corresponds to a specific example of a "charged region" of the invention. Electrostatic latent image R2 corresponds to a specific example of an "electrostatic latent image" of the invention. Note that, charged region R1 and electrostatic latent image R2 are illustrated in FIG. 8, which is described later. LED head 33 is placed facing peripheral surface 31A at second point B that is positioned downstream of first point A in the rotation direction of photosensitive drum 31. Second point B corresponds to a point indicated as "B" in FIG. 2. LED head 33 includes a plurality of LED light emitters that are arranged in the width direction of photosensitive drum 31. Each LED light emitter is configured to include, for example, a light source, such as a light-emitting diode, that emits irradiation light, and a lens array that forms an image with the irradiation light on the surface of photosensitive drum 31.

Development roller 34 is a member that supports developer 37 on a surface thereof, and develops electrostatic latent image R2 with developer 37. Development roller 34 is placed so as to come into contact with peripheral surface 31A of photosensitive drum 31, and is placed facing peripheral surface 31A at third point C that is positioned downstream of second point B in the rotation direction of photosensitive drum 31. Third point C corresponds to a point indicated as "C" in FIG. 2. Development roller 34 includes, for example, a metal shaft made of stainless steel, and a semiconducting elastic layer (for example, a semiconducting urethane rubber layer) that covers an outer circumference (surface) thereof. Development roller 34 performs a rotation operation in the direction opposite to the direction of the rotation of photosensitive drum 31 at a predetermined circumferential speed by the transmission of a drive force from photosensitive drum 31, for example.

Herein, for example, assume that photosensitive drum 31 has a diameter of 40 mm, and charge roller 32 and development roller 34 are placed at positions forming an angle of 120° with the center of photosensitive drum 31 as an axis. In this arrangement, distance L1 from first point A to third point C is approximately 41.89 mm.

Supply roller 35 is a member (supply member) that supplies developer 37 to development roller 34, and is placed so as to come into contact with a surface (peripheral surface) of development roller 34. Supply roller 35 includes, for example, a metal shaft, and a foaming elastic layer (for example, a silicone rubber layer) that covers an outer circumference (surface) thereof. Supply roller 35 performs a rotation operation in the direction opposite to the direction of rotation of development roller 34 by the transmission of a drive force from development roller 34, for example.

Cartridge 36 is a container in which developer 37 is contained. Regulation blade 38 regulates the layer thickness of developer 37 that is supported on the surface of development roller 34. Developer 37 is, for example, a non-magnetic one-component developer. Regulation blade 38 is made of, for example, a stainless steel sheet, also known as a stainless use sheet SUS, being an acronym from the Japanese Industrial Standards. Cleaning blade 39 scrapes off developer 37 remaining on the surface of photosensitive drum 31. Cleaning blade 39 is made of, for example, a flexible rubber material or plastic material.

(Configuration of Transfer Unit 40)

Transfer unit 40 is configured to electrostatically transfer an image (developer image) that is formed on peripheral surface 31A of photosensitive drum 31 onto medium PM that is conveyed from conveyance unit 20. Transfer unit 40 is configured to include, for example, a transfer roller. The transfer roller is placed facing photosensitive drum 31. The transfer roller is made of, for example, a foaming semiconducting elastic rubber material.

(Configuration of Fixation Unit 50)

Fixation unit 50 is a member that applies heat and pressure to a developer image that is formed on medium PM, after passing transfer unit 40, to fix the developer image onto medium PM. Fixation unit 50 is placed at the downstream side of transfer unit 40 in conveyance path PW. Fixation unit 50 is configured to include, for example, upper roller 51 and lower roller 52.

Upper roller 51 and lower roller 52 are configured for each to include a heat source (fuser heater 106 described later in FIG. 3) that is a heater such as a halogen lamp in the inside thereof. Upper roller 51 and lower roller 52 function as heat rollers that apply heat to the developer image on medium PM. Upper roller 51 performs a rotation operation to convey medium. PM in conveyance direction F under the control of controller 101. The heat sources in upper roller 51 and lower roller 52 are configured to respectively control the surface temperatures of upper roller 51 and lower roller 52 by being supplied with a bias voltage that is controlled by controller 101. Lower roller 52 is placed facing upper roller 51 so as to allow a pressure contact portion to be formed with upper roller 51, and functions as a pressurization roller that applies pressure to the developer image on medium PM. Lower roller 52 may preferably include a surface layer made of an elastic material.

(Configuration of Delivery Unit 60)

Delivery unit 60 is configured to deliver medium PM on which a developer image is fixed by fixation unit 50 to the outside. Delivery unit 60 includes, for example, pairs of conveyance rollers 61, 62 and 63, and sensor 64. Pairs of conveyance rollers 61, 62 and 63 deliver medium PM to the outside through conveyance path PW, and cause delivered medium PM to be stacked in external stacker 100A. Pairs of conveyance rollers 61, 62, and 63 perform rotation operations to convey medium PM in conveyance direction F under the control of controller 101. Pairs of conveyance rollers 61, 62, and 63 further deliver medium PM facedown to the outside, for example.

Sensor 64 is placed upstream of pairs of conveyance rollers 61, 62, and 63 in conveyance path PW. Sensor 64 detects a position of medium PM so as to adjust the drive timings of pairs of conveyance rollers 61, 62, and 63. Sensor 64 detects, for example, medium PM that is conveyed through conveyance path PW.

(Control Mechanism)

Figure 3:
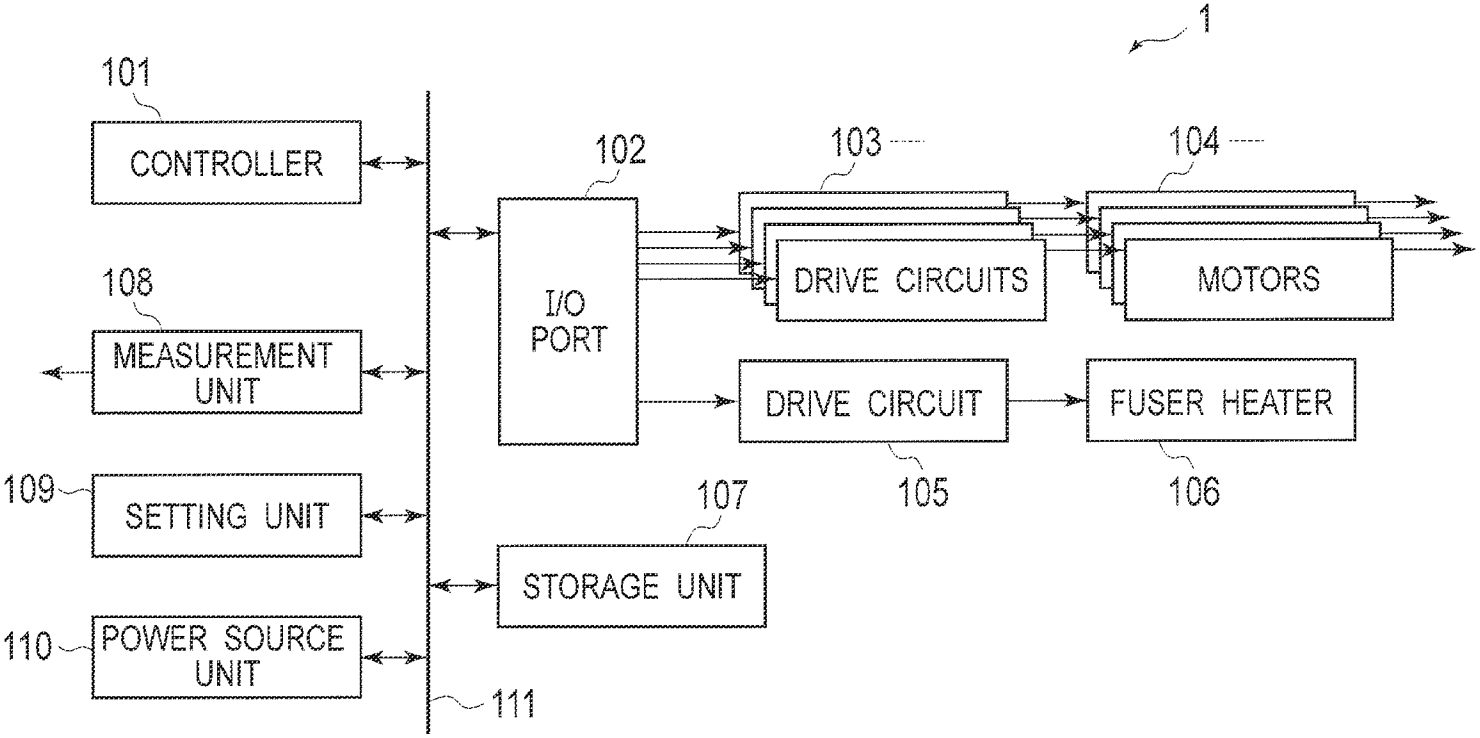
FIG. 3 is a schematic diagram illustrating an example of a part of a control mechanism of the image formation apparatus in FIG. 1.

The following describes a part of the control mechanism of image formation apparatus 1, with reference to FIG. 3 in addition to FIG. 1. FIG. 3 is a block diagram illustrating an example of a part of the control mechanism of image formation apparatus 1.

As illustrated in FIG. 1 and FIG. 3, image formation apparatus 1 includes, as the control mechanism, for example, controller 101, I/O port 102, drive circuits 103, motors 104, drive circuit 105, fuser heater 106, and storage unit 107. Image formation apparatus 1 further includes, as the control mechanism, for example, measurement unit 108, setting unit 109, and power source unit 110. Storage unit 107 corresponds to a specific example of a "storage unit" of the invention. Measurement unit 108 corresponds to a specific example of a "measurement unit" of the invention. Setting unit 109 corresponds to a specific example of a "setting unit" of the invention. Power source unit 110 corresponds to a specific example of a "power source unit" of the invention. Controller 101, I/O port 102, drive circuits 103, motors 104, drive circuit 105, fuser heater 106, storage unit 107, measurement unit 108, setting unit 109, and power source unit 110 are connected to control line 111, for example.

Controller 101 controls various kinds of controlled components in image formation apparatus 1 via control line 111, for example. I/O port 102 outputs control signals for driving various kinds of motors 104 for driving to various kinds of drive circuits 103 under the control of controller 101. I/O port 102 further outputs a control signal for driving fuser heater 106 to drive circuit 105 under the control of controller 101. Drive circuits 103 perform pulse controls of motors 104 that rotate various kinds of drums or various kinds of rollers under the control of I/O port 102. Drive circuit 103 for photosensitive drum 31 performs a pulse control of motor 104 that rotates photosensitive drum 31.

Figure 4:
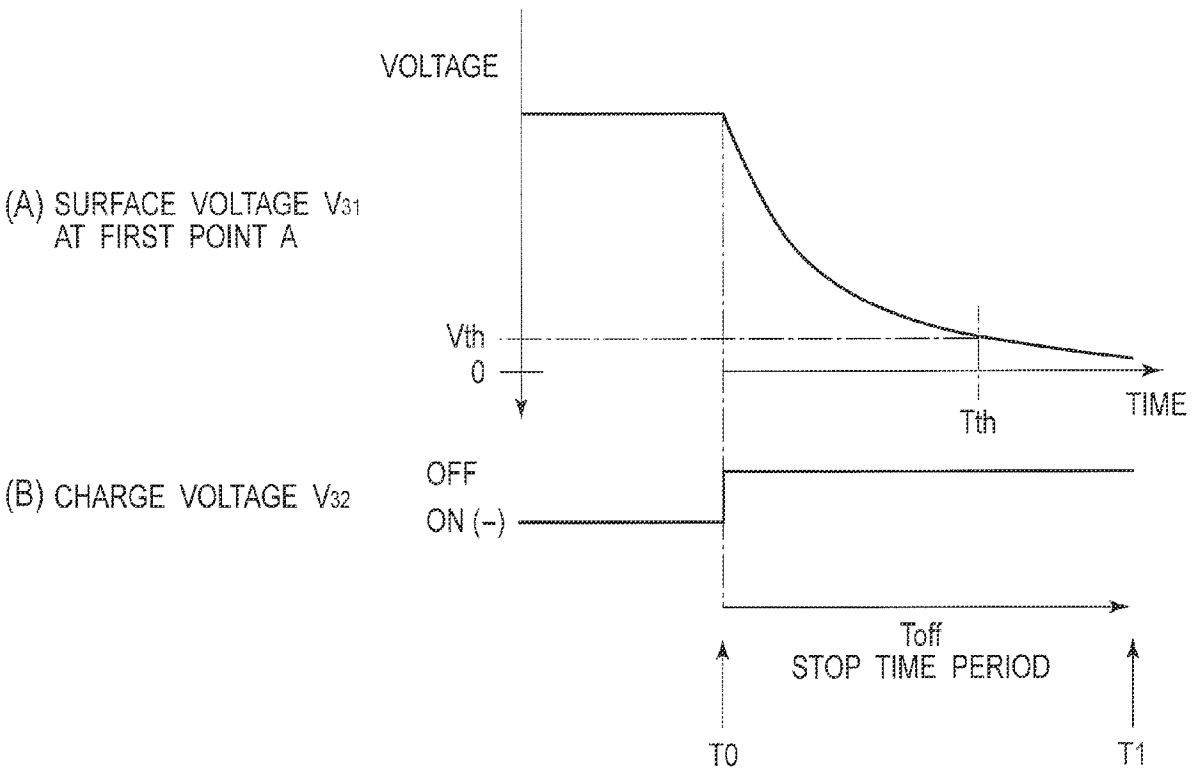
FIG. 4 shows waveform diagrams (A) and (B) illustrating examples of time-dependent changes in the voltage of a photosensitive drum and a charge roller.

Drive circuit 105 performs a pulse control of fuser heater 106. Fuser heaters 106 are respectively provided inside upper roller 51 and lower roller 52, and heat upper roller 51 and lower roller 52. Fuser heaters 106 stop the heating of upper roller 51 and lower roller 52 in synchronization with a stop of the rotation of photosensitive drum 31, or start the heating of upper roller 51 and lower roller 52 before a start of the rotation of photosensitive drum 31. Fuser heater 106 is, for example, a heating heater such as a halogen lamp. Storage unit 107 stores therein a control program for operating image formation apparatus 1. Storage unit 107 further stores therein development voltage table 120 (FIG. 5A) or development voltage function 130 (FIG. 5B), and threshold value $T_{th}$ (FIG. 4). Development voltage table 120 corresponds to a specific example of a "table" of the invention. Development voltage function 130 corresponds to a specific example of a "function" of the invention. Threshold value $T_{th}$ corresponds to a specific example of a "first threshold value" of the invention.

Next, the following describes development voltage table 120 and development voltage function 130. Waveform (A) in FIG. 4 illustrates an example of a time-dependent change in surface voltage $V_{31}$ at first point A of photosensitive drum 31. Waveform (B) in FIG. 4 illustrates an example of a time-dependent change in charge voltage $V_{32}$. Charge voltage $V_{32}$ is a voltage to be applied to charge roller 32 so as to charge a surface (surface layer portion) of charge roller 32. The time is elapsed toward the right side on the horizontal axes in waveforms (A) and (B) in FIG. 4. The negative voltage becomes large toward the upper side on the longitudinal axis in waveform (A) in FIG. 4. In FIG. 4, T0 represents the time when the rotation of photosensitive drum 31 is stopped (rotation stop time), and $T_{off}$ represents a time period when the rotation of photosensitive drum 31 is being stopped, that is, a time period (stop time period) from rotation stop time T0 to the time when the rotation of photosensitive drum 31 is started (rotation start time T1). Stop time period $T_{off}$ corresponds to a specific example of a "stop time period" of the invention. Rotation start time T1 corresponds to a specific example of a "rotation start time" of the invention.

Simultaneously with the stop of the rotation of photosensitive drum 31, charge voltage $V_{32}$ is cut off and becomes 0 volt. Surface voltage $V_{31}$ at first point A of photosensitive drum 31 is then attenuated with the elapse of time, and eventually becomes 0 volt or a voltage close to 0 volt. Development voltage table 120 and development voltage function 130 contain data obtained by the measurement or the prediction of such attenuation of surface voltage $V_{31}$.

Figures 5A, 5B, 6:
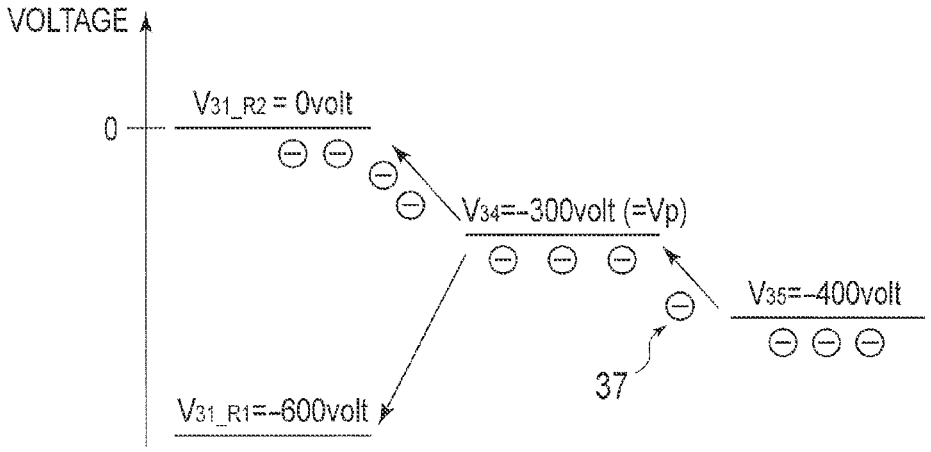
FIG. 5A is a diagram illustrating an example of a development voltage table.
FIG. 5B is a diagram illustrating an example of a development voltage function.
FIG. 6 is a schematic diagram illustrating the respective voltages of the photosensitive drum, a development roller, and a supply roller, and the transition of a developer, when a developer image is formed.

FIG. 5A illustrates an example of development voltage table 120. FIG. 5B illustrates an example of development voltage function 130. Development voltage table 120 is a table in which development voltage $V_{34}$ is associated with stop time period $T_{off}$. Development voltage $V_{34}$ is a voltage to be applied to development roller 34 so as to make the surface (surface layer portion) of development roller 34 have a negative potential. In development voltage table 120, development voltage $V_{34}$ varies to Va, Va, Vb, . . . , Vb as stop time period $T_{off}$ varies to t1, t2, t3, . . . , tn. Development voltage function 130 is a function in which development voltage $V_{34}$ is associated with stop time period $T_{off}$. In development voltage function 130, development voltage $V_{34}$ varies to Va, Va, Vb, . . . , Vb as stop time period $T_{off}$ varies to t1, t2, t3, . . . , tn.

Herein, Va is a voltage higher than surface voltage $V_{31}$ and lower than 0 volt. Va is a voltage having a negative polarity, and includes negative polar data. Vb is a voltage higher than 0 volt. Vb is a voltage having a positive polarity, and includes positive polar data. Accordingly, development voltage table 120 is also a table in which the polarity of development voltage $V_{34}$ is associated with stop time period $T_{off}$. Moreover, development voltage function 130 is also a function in which the polarity of development voltage $V_{34}$ is associated with stop time period $T_{off}$.

Next, the following describes measurement unit 108, setting unit 109, and power source unit 110.

Measurement unit 108 measures stop time period $T_{off}$. Measurement unit 108 is a counter that measures the time by seconds, for example. Measurement unit 108 starts the measurement of a time, for example, when detecting a control signal that is outputted from I/O port 102, and is used to stop the driving of motor 104 connected to photosensitive drum 31. Measurement unit 108 outputs the measured time period (stop time period $T_{off}$) to controller 101. Measurement unit 108 stops the measurement of time, for example, when detecting a control signal that is outputted from I/O port 102 and is used to stop the driving of motor 104 connected to photosensitive drum 31. Measurement unit 108 may be configured separately from controller 101, or may be configured as one of the functions of controller 101.

Setting unit 109 sets the polarity of initial voltage Vi to be applied to development roller 34, based on stop time period $T_{off}$ measured by measurement unit 108. Initial voltage Vi corresponds to a specific example of an "initial voltage" of the invention. Setting unit 109 uses development voltage table 120 or development voltage function 130 that is read from storage unit 107 to obtain polar data corresponding to stop time period $T_{off}$ measured by measurement unit 108, and sets the obtained polar data as the polarity of initial voltage Vi. Moreover, setting unit 109 uses development voltage table 120 or development voltage function 130 that is read from storage unit 107 to obtain polar data and development voltage data corresponding to stop time period $T_{off}$ as measured by measurement unit 108, and sets the polarity and a voltage value of initial voltage Vi based on the obtained polar data and development voltage data.

Setting unit 109 sets the polarity of initial voltage Vi to be negative when stop time period $T_{off}$ measured by measurement unit 108 is not more than threshold value $T_{th}$. Setting unit 109 sets the polarity of initial voltage Vi to be positive when stop time period $T_{off}$ measured by measurement unit 108 is more than threshold value $T_{th}$. Threshold value $T_{th}$ is stop time period $T_{off}$ when the voltage of electrostatic latent image R2 on photosensitive drum 31 is at a predetermined value (threshold value $V_{th}$). Threshold value $V_{th}$ is an upper limit value of surface voltage $V_{31}$ of photosensitive drum 31 at which developer 37 is less likely to be attracted to photosensitive drum 31 even when the polarity of initial voltage Vi is positive. Further, threshold value $T_{th}$ corresponds to stop time period t2, for example, in development voltage table 120 and development voltage function 130.

Setting unit 109 sets a voltage value higher than voltage $V_{31_R1}$, which is described later in FIG. 6, as a value of initial voltage Vi, when setting the polarity of initial voltage Vi to be negative. Voltage $V_{31_R1}$ corresponds to a specific example of a "voltage value in the charged region" of the invention. When the polarity of initial voltage Vi is set to be negative, initial voltage Vi is preferably higher by at least 100 volts than voltage $V_{31_R1}$ by considering the instability of surface voltage $V_{31}$. Herein, when a normal voltage (printing voltage Vp) to be applied to development roller 34 has a value of voltage higher than voltage $V_{31_R1}$, which is described later, setting unit 109 may set initial voltage Vi to a value equal to a value of printing voltage Vp. Printing voltage Vp is a voltage to be applied to development roller 34 at printing start time T3 and during printing. Printing voltage Vp corresponds to a specific example of a "voltage value to be applied to the development member during printing" of the invention.

Setting unit 109 outputs information related to set initial voltage Vi to power source unit 110. When setting unit 109 sets the polarity of initial voltage Vi, setting unit 109 outputs information related to the set polarity of initial voltage Vi to power source unit 110. When setting unit 109 sets the polarity and a voltage value of initial voltage Vi, setting unit 109 outputs information related to the set polarity and voltage value of initial voltage Vi to power source unit 110. Further, when the value of negative voltage capable of being outputted as initial voltage Vi is limited to one value of negative voltage in power source unit 110, setting unit 109 does not necessarily provide the one value of negative voltage to power source unit 110. Accordingly, in such a case, setting unit 109 may set only the polarity of initial voltage Vi without setting a voltage value of initial voltage Vi, and output only information related to the set polarity of initial voltage Vi to power source unit 110.

Power source unit 110 applies initial voltage Vi with the polarity set by setting unit 109 to development roller 34 at rotation start time T1 of photosensitive drum 31. Power source unit 110 applies initial voltage Vi with the polarity set by setting unit 109 to development roller 34 within a period (rotation initial period ΔTi) from rotation start time T1 to transfer start time (printing start time T3) of a developer image formed by development by development roller 34. Rotation initial period ΔTi corresponds to a specific example of a "period from rotation start time to the transfer start time of a developer image formed by development by the development member" of the invention. When the polarity of initial voltage Vi set by setting unit 109 is negative, power source unit 110 may apply, to development roller 34, initial voltage Vi with a voltage value equal to a voltage value (printing voltage Vp) to be applied to development roller 34 during printing. Note that, printing start time T3 and rotation initial period ΔTi are exemplified in FIG. 8, which is described later.

Power source unit 110 may apply initial voltage Vi to development roller 34 for a period that is only a part of rotation initial period ΔTi. Power source unit 110 may apply initial voltage Vi to development roller 34 only within a period, for example, from rotation start time T1 to a time (initial voltage stop time T2) immediately before printing start time T3. Initial voltage stop time T2 is the time when a portion of peripheral surface 31A of photosensitive drum 31 located in first point A at rotation start time T1 is moved to third point C with the rotation of photosensitive drum 31. Further, initial voltage stop time T2 is exemplified in FIG. 8, which is described later.

[Operation]

Next, the following describes an overview of an operation of image formation apparatus 1. In image formation apparatus 1, a developer image is formed on medium PM in the following manner. When a printing job is supplied to controller 101 via a communication channel from an image transfer apparatus connected to image formation apparatus 1, controller 101 executes a printing process based on the printing job such that the respective members in image formation apparatus 1 perform the following operations.

Firstly, fuser heaters 106 start to heat upper roller 51 and lower roller 52. When upper roller 51 and lower roller 52 reach a predetermined temperature, pickup roller 12 separates and takes out medium PM that is contained in paper feed tray 11 one by one from the upper-most part, and feeds out medium PM onto conveyance path PW. Next, pair of registration rollers 21 corrects the skew of medium PM by the contact process, and thereafter conveys medium PM to pair of registration rollers 22. Subsequently, pair of registration rollers 22 (or, pairs of registration rollers 21, 22) conveys medium PM in conveyance direction F along conveyance path PW. At this time, sensor 25 detects medium PM while medium PM is passing a region opposed to sensor 25. When sensor 25 detects medium PM, an operation of image formation unit 30 is started, medium PM is conveyed to transfer unit 40, and a developer image formed in image formation unit 30 in the following manner is transferred onto medium PM. In this manner, an image is printed onto medium PM.

FIG. 6 schematically illustrates the respective voltages of photosensitive drum 31, development roller 34, and supply roller 35, and the transition of developer 37, when a developer image is formed. In image formation unit 30, a developer image is formed by the following electrophotographic process. Firstly, power source unit 110 applies a charge voltage $V_{32}$ to charge roller 32 to equally charge the surface (surface layer portion) of charge roller 32, and along with the charge, a portion, within peripheral surface 31A of photosensitive drum 31, which is in contact with charge roller 32 is also charged to a predetermined voltage $V_{31_R1}$ (for example, −600 volts). Subsequently, LED head 33 emits irradiation light toward the region (charged region R1) within peripheral surface 31A of photosensitive drum 31, which is charged to voltage $V_{31_R1}$ to expose peripheral surface 31A of photosensitive drum 31, so that electrostatic latent image R2 in accordance with a printing pattern defined by the above-mentioned printing job is formed on peripheral surface 31A. At this time, voltage $V_{31_R2}$ at a portion, within peripheral surface 31A of photosensitive drum 31, which corresponds to electrostatic latent image R2 becomes, for example, approximately 0 volt.

Meanwhile, power source unit 110 applies a supply voltage $V_{35}$ to supply roller 35 to cause the surface (surface layer portion) of supply roller 35 to have a predetermined voltage (for example, −400 volts). Similarly, power source unit 110 applies development voltage $V_{34}$ to development roller 34 to cause the surface (surface layer portion) of development roller 34 to have a predetermined voltage (for example, −300 volts). At this time, supply roller 35 and development roller 34 that come into contact with each other respectively rotate at predetermined circumferential speeds. This causes negatively charged developer 37 to be attracted to development roller 34 due to a potential difference between supply voltage $V_{35}$ and a development voltage $V_{34}$. As a result, developer 37 is supplied from the surface of supply roller 35 to the surface of development roller 34. Subsequently, developer 37 on development roller 34 is charged due to friction or the like of regulation blade 38 that comes into contact with development roller 34. Herein, the thickness of developer 37 on development roller 34 is determined based on development voltage $V_{34}$, supply voltage $V_{35}$, a pressing pressure by regulation blade 38, and the like. Moreover, development roller 34 and photosensitive drum 31 that come into contact with each other respectively rotate at predetermined circumferential speeds. This causes negatively charged developer 37 to be attracted to photosensitive drum 31 due to a potential difference between development voltage $V_{34}$ and voltage $V_{31_R2}$ at the portion, within peripheral surface 31A of photosensitive drum 31, which corresponds to electrostatic latent image R2. As a result, developer 37 is adhered onto electrostatic latent image R2 on photosensitive drum 31. Further, negatively charged developer 37 is not attracted to charged region R1 because voltage $V_{31_R1}$ at the portion, within peripheral surface 31A of photosensitive drum 31, which corresponds to charged region R1 is lower than development voltage $V_{34}$.

Thereafter, a developer image on photosensitive drum 31 is transferred onto medium PM due to an electric field between photosensitive drum 31 and the transfer roller in transfer unit 40. Further, cleaning blade 39 scrapes off and removes developer remaining on the surface of photosensitive drum 31. Subsequently, fixation unit 50 applies heat and pressure to the developer image on medium PM to fix the developer image onto medium PM.

The following describes an operation of image formation apparatus 1 in detail. Hereinafter, specifically, an operation of image formation apparatus 1 when photosensitive drum 31 starts a rotation from a stop state is described in detail. Note that, hereinafter, it is assumed that measurement unit 108 is a counter that measures the time in units of one second, and measurement unit 108 is configured as one of the functions of controller 101.

Figure 7:
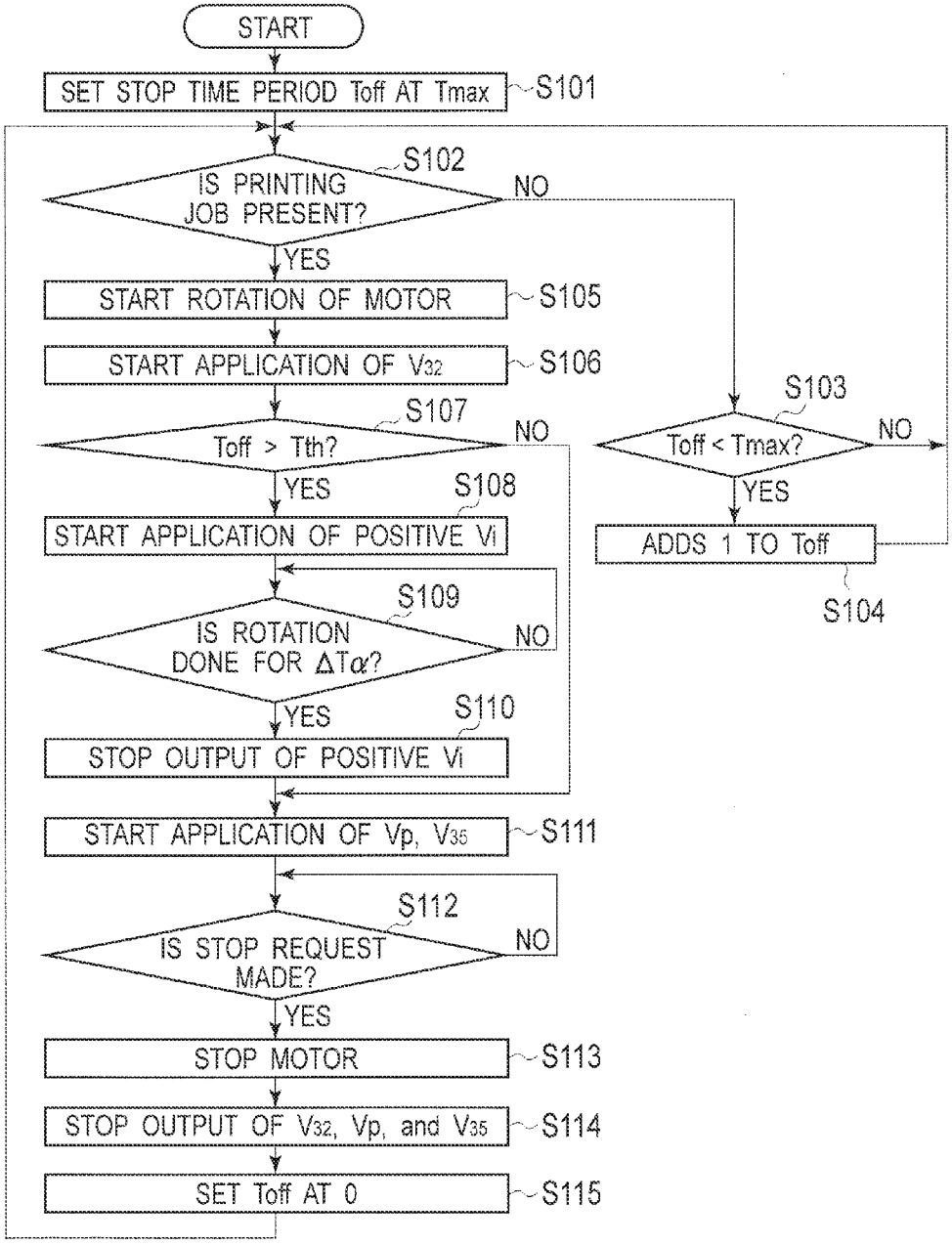
FIG. 7 is a flowchart illustrating an example of a procedure of an operation of the image formation apparatus.
Figure 9:
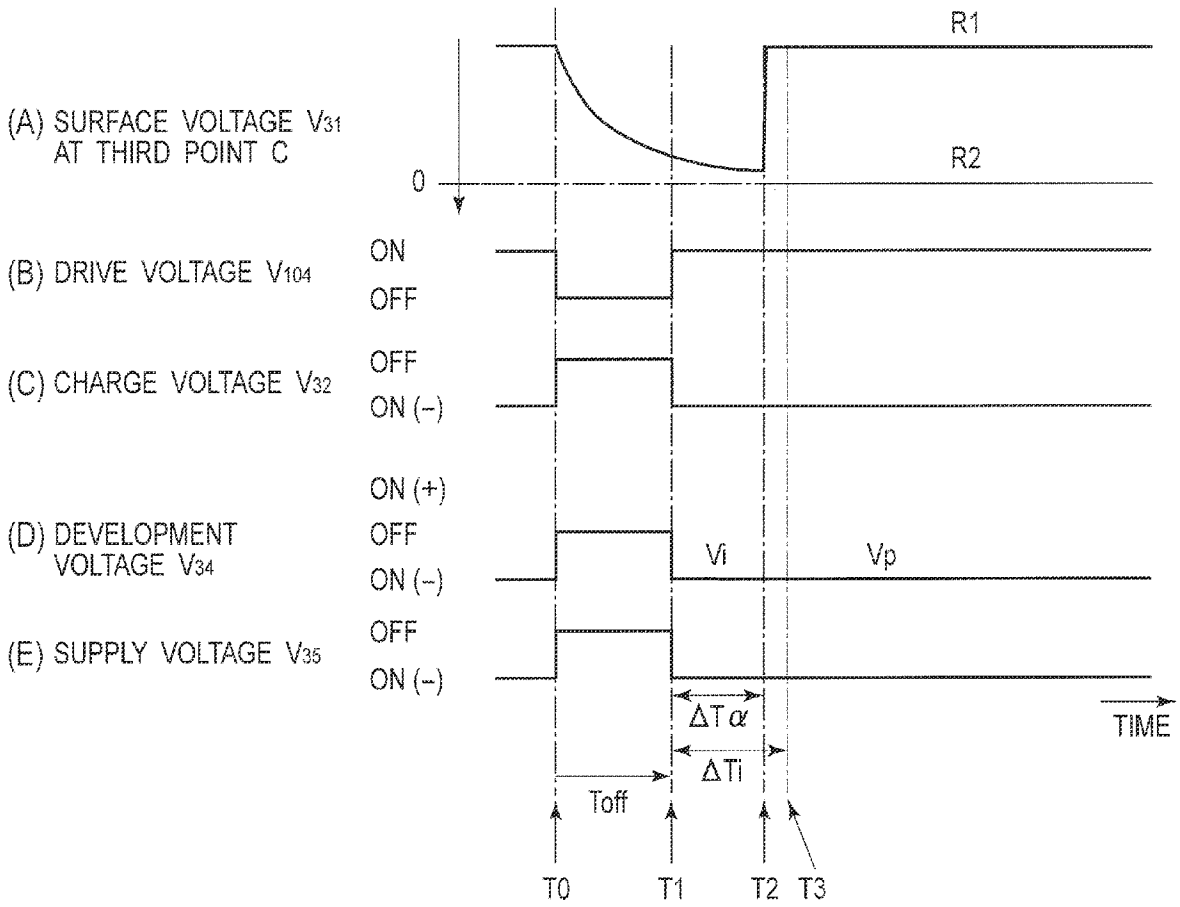
FIG. 9 shows waveform diagrams (A) to (E) illustrating examples of various kinds of waveforms in the image formation apparatus.

FIG. 7 illustrates an example of a procedure of the operation of image formation apparatus 1. FIGS. 8 and 9 illustrate examples of various kinds of waveforms in image formation apparatus 1. Waveforms (A) in FIGS. 8 and 9 illustrate examples of the waveforms of surface voltage $V_{31}$ at third point C of photosensitive drum 31. Waveforms (B) in FIGS. 8 and 9 illustrate examples of the waveforms of drive voltage $V_{104}$ to be applied to motor 104 connected to photosensitive drum 31. Waveforms (C) in FIGS. 8 and 9 illustrate examples of the waveforms of charge voltage $V_{32}$. Waveforms (D) in FIGS. 8 and 9 illustrate examples of the waveforms of development voltage $V_{34}$. Waveforms (E) in FIGS. 8 and 9 illustrate examples of the waveforms of supply voltage $V_{35}$. In FIGS. 8 and 9, ON (+) indicates that a voltage to be applied has a positive voltage value, whereas ON (−) indicates that a voltage to be applied has a negative voltage value. Moreover, in FIGS. 8 and 9, $\Delta T\alpha$ indicates a time period (passage time period) necessary for a region from first point A to third point C in peripheral surface 31A of photosensitive drum 31 to pass third point C with the rotation of photosensitive drum 31.

Firstly, when controller 101 detects a power supply of image formation apparatus 1 being turned on, measurement unit 108 sets stop time period $T_{off}$ at $T_{max}$ (Step S101). $T_{max}$ is a value not less than threshold value $T_{th}$. Stop time period $T_{off}$ is set at $T_{max}$ because measurement unit 108 cannot measure the time while the power supply of image formation apparatus 1 is turned off. Moreover, stop time period $T_{off}$ is set at $T_{max}$ because an actual stop time period of photosensitive drum 31 is considered to be more than threshold value $T_{th}$. When measurement unit 108 measures stop time period $T_{off}$ from rotation stop time T0 while the power supply of image formation apparatus 1 is kept on, Step S101 above is omitted.

Next, controller 101 determines whether the above-mentioned printing job is present (Step S102). If the above-mentioned printing job is not present, in other words, before controller 101 accepts the above-mentioned printing job, controller 101 determines whether stop time period $T_{off}$ is less than $T_{max}$ (Step S103). As a result, if stop time period $T_{off}$ is less than $T_{max}$ and one second has passed from a previous count by a counter, controller 101 adds 1 to stop time period $T_{off}$ (Step S104). On the other hand, if stop time period $T_{off}$ is not less than $T_{max}$, controller 101 returns the processing to Step S102. Meanwhile, if stop time period $T_{off}$ is less than $T_{max}$ and one second has not passed from the previous count by the counter, controller 101 returns the processing to Step S102 without adding 1 to stop time period $T_{off}$.

If the power supply of image formation apparatus 1 is detected as being turned on, stop time period $T_{off}$ is always equal to $T_{max}$ irrespective of a timing when the above-mentioned printing job is inputted. On the other hand, if the power supply of image formation apparatus 1 is kept on and the counter measures stop time period $T_{off}$ from rotation stop time T0, stop time period $T_{off}$ may be less than $T_{max}$ or not less than $T_{max}$ depending on the timing when the above-mentioned printing job is inputted. Note that, FIG. 8 illustrates examples of various kinds of waveforms (A) to (E) produced when stop time period $T_{off}$ is not less than $T_{max}$. Moreover, FIG. 9 illustrates examples of various kinds of waveforms (A) to (E) produced when stop time period $T_{off}$ is less than $T_{max}$.

When the above-mentioned printing job is inputted and sensor 25 detects medium PM, controller 101 instructs I/O port 102 to output a control signal for driving motor 104 connected to photosensitive drum 31. In response to the instruction, I/O port 102 outputs a control signal for driving motor 104 connected to photosensitive drum 31 to drive circuit 103 provided to photosensitive drum 31 under the control of controller 101. This causes drive circuit 103 provided to photosensitive drum 31 to output drive voltage $V_{104}$ to motor 104 connected to photosensitive drum 31. As a result, the rotation of motor 104 connected to photosensitive drum 31 is started (Step S105, T1). At this time, controller 101 instructs power source unit 110 to output charge voltage $V_{32}$ (for example, −800 volts) that charges charge roller 32. In response to the instruction, power source unit 110 starts to apply charge voltage $V_{32}$ to charge roller 32 (Step S106, T1). This causes charge roller 32 to be negatively charged, for example, and first point A on peripheral surface 31A of photosensitive drum 31 to have a negative voltage from charge roller 32.

Figure 10A:
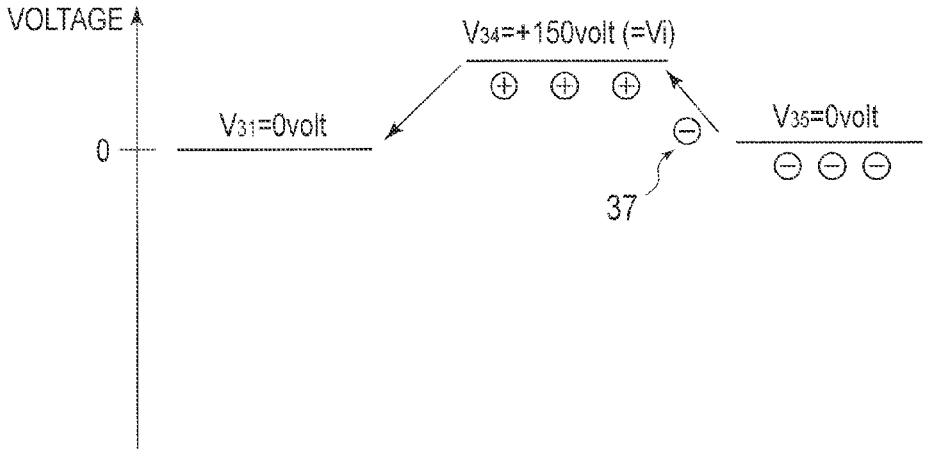
FIG. 10A is a schematic diagram illustrating the respective voltages of the photosensitive drum, the development roller, and the supply roller, and the transition of the developer, when a positive voltage is applied as an initial voltage of the development roller.

Controller 101 instructs setting unit 109 to compare stop time period $T_{off}$ with threshold value $T_{th}$. In response to the instruction, setting unit 109 starts to compare stop time period $T_{off}$ with threshold value $T_{th}$. Specifically, setting unit 109 determines whether stop time period $T_{off}$ is more than threshold value $T_{th}$ (Step S107). As a result, if stop time period $T_{off}$ is more than threshold value $T_{th}$, controller 101 instructs power source unit 110 to output a positive voltage (initial voltage Vi) as development voltage $V_{34}$ at which development roller 34 is charged. In response to the instruction, power source unit 110 starts to apply a positive voltage (for example, an initial voltage Vi of +150 volts) to development roller 34 (Step S108, T1). This causes development voltage $V_{34}$ to become initial voltage Vi of +150 volts, for example, as illustrated in FIG. 10A. As a result, negatively charged developer 37 is attracted to the positive voltage of development roller 34, so that developer 37 on development roller 34 does not move to peripheral surface 31A of photosensitive drum 31.

Figure 10B:
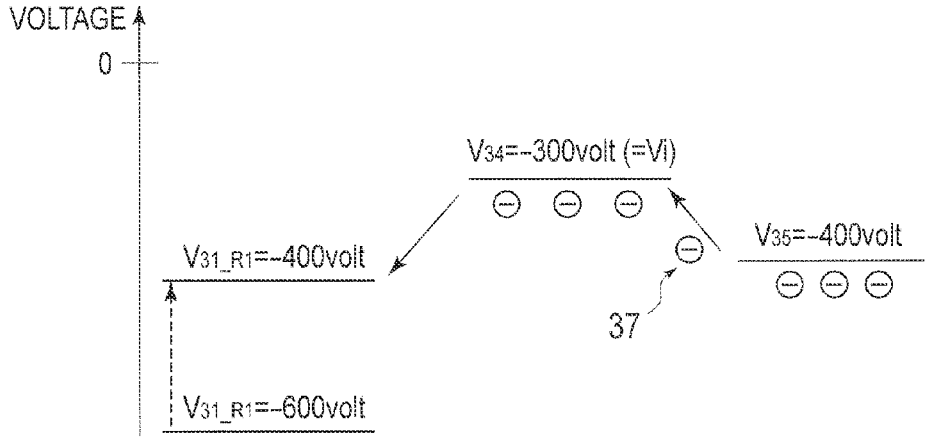
FIG. 10B is a schematic diagram illustrating the respective voltages of the photosensitive drum, the development roller, and the supply roller, and the transition of the developer, when a negative voltage is applied as an initial voltage of the development roller.

Moreover, as a result of the above-mentioned determination, if stop time period $T_{off}$ is not more than threshold value $T_{th}$, controller 101 instructs power source unit 110 to output a negative voltage (initial voltage Vi) as development voltage $V_{34}$ at which development roller 34 is charged. In response to the instruction, power source unit 110 starts to apply a negative voltage (for example, an initial voltage Vi of −300 volts) to development roller 34 (Step S111). This causes development voltage $V_{34}$ to become initial voltage Vi of −300 volts, for example, as illustrated in FIG. 10B. As a result, negatively charged developer 37 is not attracted to charged region R1 because voltage $V_{31_R1}$ at the portion, within peripheral surface 31A of photosensitive drum 31, which corresponds to charged region R1, becomes lower than development voltage $V_{34}$.

After Step S108 is executed, controller 101 determines whether photosensitive drum 31 rotates for passage time period ΔTα (Step S109). If photosensitive drum 31 rotates for passage time period ΔTα, controller 101 instructs power source unit 110 to stop the output of the positive voltage (initial voltage Vi). In response to the instruction, power source unit 110 stops the output of the positive voltage (initial voltage Vi) (Step S110, T2).

After Step S110 is executed, or the application of a negative voltage (initial voltage Vi) to development roller 34 is executed because stop time period $T_{off}$ is not more than threshold value $T_{th}$, controller 101 executes the following control. Firstly, at a predetermined timing, controller 101 instructs power source unit 110 to output a negative voltage (printing voltage Vp) as development voltage $V_{34}$, and instructs power source unit 110 to output a negative voltage (for example, −400 volt) as supply voltage $V_{35}$. In response to the instruction, power source unit 110 starts to apply a negative voltage (for example, a printing voltage Vp of −300 volts) to development roller 34 (Step S111, T3). This causes development roller 34 to have a negative voltage (for example, printing voltage Vp of −300 volts). Power source unit 110 further starts to apply a negative voltage (for example, supply voltage $V_{35}$ of −400 volts) to supply roller 35 (Step S111, T3). This causes supply roller 35 to have a negative voltage (for example, supply voltage $V_{35}$ of −400 volts). The timing when development voltage $V_{34}$ changes to printing voltage Vp and the timing when supply voltage $V_{35}$ is supplied to supply roller 35 are identical with each other, as illustrated in FIG. 8, for example.

Thereafter, controller 101 determines whether a stop request of printing is made (Step S112). Controller 101 repeatedly executes Step S112 before the stop request of printing is made. If the stop request of printing is made, controller 101 instructs I/O port 102 to output a control signal for stopping the driving of motor 104 connected to photosensitive drum 31. In response to the instruction, I/O port 102 outputs a control signal for stopping the driving of motor 104 connected to photosensitive drum 31 to drive circuit 103 provided to photosensitive drum 31 under the control of controller 101. This causes drive circuit 103 provided to photosensitive drum 31 to stop the supply of drive voltage $V_{104}$ to motor 104 connected to photosensitive drum 31. As a result, the rotation of motor 104 connected to photosensitive drum 31 is stopped (Step S113, T0).

At this time, controller 101 instructs power source unit 110 to stop the outputs of charge voltage $V_{32}$, development voltage $V_{34}$, and supply voltage $V_{35}$. In response to the instruction, power source unit 110 stops the supply of charge voltage $V_{32}$, development voltage $V_{34}$, and supply voltage $V_{35}$ respectively to charge roller 32, development roller 34, and supply roller 35 (Step S114). Lastly, controller 101 sets stop time period $T_{off}$ at 0 (Step S115).

[Effect]

Next, the following describes an effect of image formation apparatus 1. Generally, an electrophotographic image formation apparatus is configured such that the surface voltage of a photosensitive drum is close to 0 volt immediately after a power supply is turned on or when a development unit is started up after a long standby state. When a normal development process is executed in that state, a negative voltage is applied to a development roller to negatively charge a developer on the development roller. At this time, a potential difference between the photosensitive drum and the development roller is generated, so that the negatively charged developer on the development roller is attracted to the photosensitive drum, and is consequently consumed wastefully. To cope with this situation, for example, it is conceivable to prevent a developer from being attracted to a photosensitive drum by applying a positive voltage to a development roller until a region of a peripheral surface of the photosensitive drum, where the surface voltage of the photosensitive drum is close to 0 volt, finishes passing the development roller.

Figure 11:
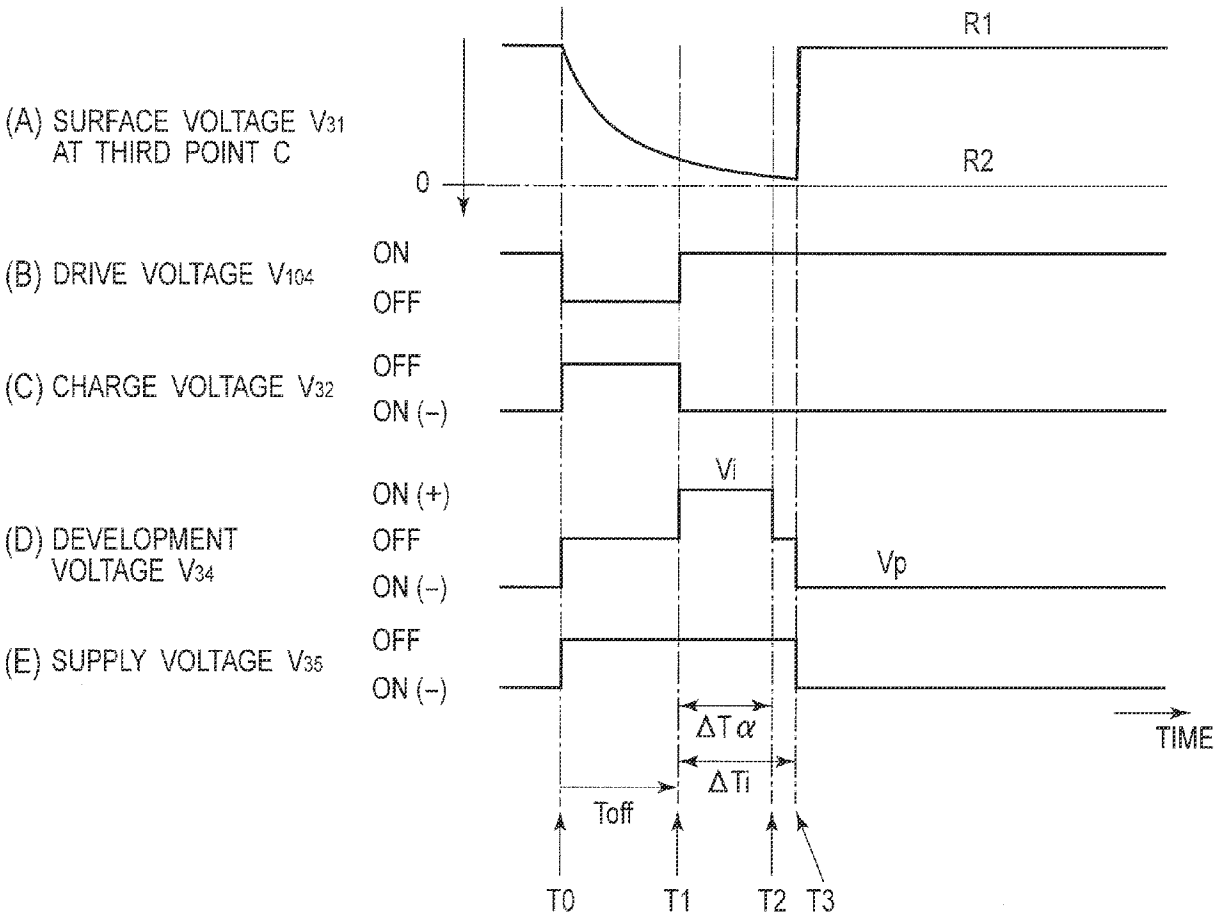
FIG. 11 shows waveform diagrams (A) to (E) illustrating examples of various kinds of waveforms in an image formation apparatus according to a comparative example.
Figures 12, 13A, 13B:
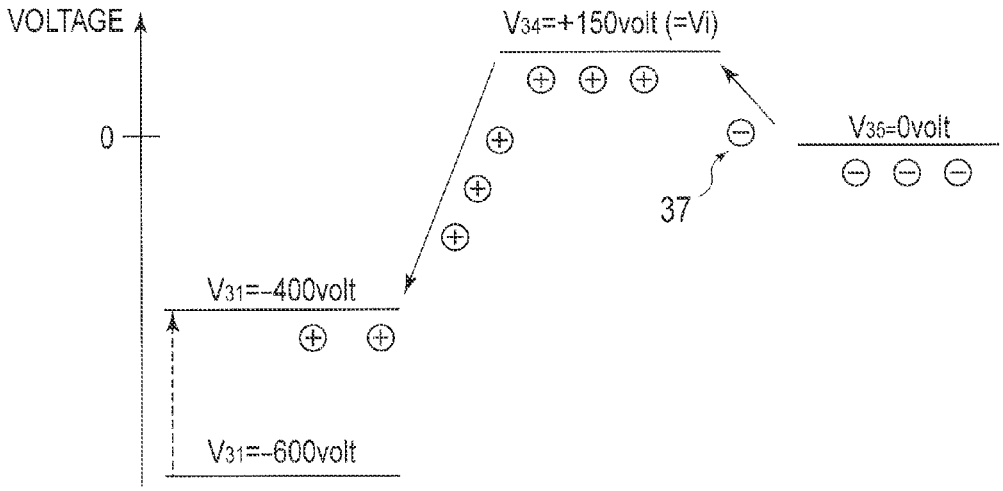
FIG. 12 is a schematic diagram illustrating the respective voltages of a photosensitive drum, a development roller, and a supply roller, and the transition of a developer, when a positive voltage is applied as an initial voltage of the development roller, in the image formation apparatus according to the comparative example.
FIG. 13A is a diagram illustrating an example of a polar table.
FIG. 13B is a diagram illustrating an example of a polar function.

FIG. 11 illustrates examples of various kinds of waveforms in an image formation apparatus according to a comparative example. FIG. 12 illustrates an example of the respective voltages ($V_{31}$, $V_{34}$, and $V_{35}$) of photosensitive drum 31, development roller 34, and supply roller 35, and the transition of developer 37, when a developer image is formed. In FIG. 11, positive initial voltage Vi is applied to development roller 34 until a region of peripheral surface 31A of photosensitive drum 31, where surface voltage $V_{31}$ of photosensitive drum 31 is close to 0 volt, finishes passing development roller 34.

Meanwhile, in a case where an operation such as printing is ended and the photosensitive drum 31 is temporarily stopped, and immediately after the temporal stop, the operation such as printing is started again, the photosensitive drum 31 starts to rotate before the surface voltage of the photosensitive drum 31 is attenuated, in some cases. In this case, as illustrated in waveform (D) of FIG. 11, assume that a positive initial voltage Vi is applied to development roller 34. At this time, for example, as illustrated in FIG. 12, developer 37 positively charged on development roller 34 is strongly attracted to the negatively charged surface of photosensitive drum 31. This results in the wasteful consumption of developer 37 in the image formation apparatus according to the comparative example.

Meanwhile, in image formation apparatus 1, the polarity of initial voltage Vi to be applied to development roller 34 is set based on stop time period $T_{off}$ that is a period when the rotation of photosensitive drum 31 is stopped. Specifically, the polarity corresponding to stop time period $T_{off}$ measured by measurement unit 108 is set as the polarity of initial voltage Vi, using development voltage table 120 or development voltage function 130 that is read from storage unit 107. If stop time period $T_{off}$ measured by measurement unit 108 is not more than threshold value $T_{th}$, the polarity of initial voltage Vi is set to be negative. If stop time period $T_{off}$ measured by measurement unit 108 is more than threshold value $T_{th}$, the polarity of initial voltage Vi is set to be positive. The polarity of initial voltage Vi is set in this manner in image formation apparatus 1 to prevent developer 37 on development roller 34 from being attracted to the surface of photosensitive drum 31, as illustrated in FIG. 10A and FIG. 10B, for example. As a result, the wasteful consumption of developer 37 can be reduced.

<2. Modification Examples>

The following describes modification examples of image formation apparatus 1 in the above-mentioned embodiment. Note that, hereinafter, the components common to those in the above-mentioned embodiment are assigned with the same reference numerals that are assigned in the above-mentioned embodiment. Moreover, explanations are made mainly to the components different from those in the above-mentioned embodiment, and explanations for the components common to those in the above-mentioned embodiment are omitted, as appropriate.

[First Modification Example]

In a first modification example, polar table 140 and polar function 150 are respectively used instead of development voltage table 120 and development voltage function 130. Storage unit 107 stores therein polar table 140 and polar function 150 instead of development voltage table 120 and development voltage function 130. Polar table 140 corresponds to a specific example of a "table" of the invention. Polar function 150 corresponds to a specific example of a "function" of the invention.

FIG. 13A illustrates an example of polar table 140. FIG. 13B illustrates an example of polar function 150. Polar table 140 is a table in which polarity $P_{34}$ of development voltage $V_{34}$ is associated with stop time period $T_{off}$. In polar table 140, polarity $P_{34}$ of development voltage $V_{34}$ is minus (−) when stop time period $T_{off}$ is t1 and t2, and polarity $P_{34}$ of development voltage $V_{34}$ is plus (+) when stop time period $T_{off}$ is t3 to tn. Polar function 150 is a function in which polarity $P_{34}$ of development voltage $V_{34}$ is associated with stop time period $T_{off}$. In polar function 150, polarity $P_{34}$ of development voltage $V_{34}$ is minus (−) when stop time period $T_{off}$ is t1 and t2, and polarity $P_{34}$ of development voltage $V_{34}$ is plus (+) when stop time period $T_{off}$ is t3 to tn.

In the first modification example, setting unit 109 sets the polarity of initial voltage Vi to be applied to development roller 34, based on stop time period $T_{off}$ measured by measurement unit 108. Setting unit 109 uses polar table 140 or polar function 150 that is read from storage unit 107 to set polar data ($P_{34}$) corresponding to stop time period $T_{off}$ measured by measurement unit 108, as the polarity of initial voltage Vi. Setting unit 109 sets the polarity of initial voltage Vi to be negative when stop time period $T_{off}$ measured by measurement unit 108 is not more than threshold value $T_{th}$. Setting unit 109 sets the polarity of initial voltage Vi to be positive when stop time period $T_{off}$ measured by measurement unit 108 is more than threshold value $T_{th}$. In the first modification example, threshold value $T_{th}$ is t2.

In the first modification example, in image formation apparatus 1, the polarity of initial voltage Vi to be applied to development roller 34 is set based on stop time period $T_{off}$ that is a period when the rotation of photosensitive drum 31 is stopped. Specifically, the polarity corresponding to stop time period $T_{off}$ measured by measurement unit 108 is set as the polarity of initial voltage Vi using polar table 140 or polar function 150 that is read from storage unit 107. If stop time period $T_{off}$ measured by measurement unit 108 is not more than threshold value $T_{th}$, the polarity of initial voltage Vi is set to be negative. Meanwhile, if stop time period $T_{off}$ measured by measurement unit 108 is more than threshold value $T_{th}$, the polarity of initial voltage Vi is set to be positive. The polarity of initial voltage Vi is set in this manner in image formation apparatus 1 to prevent developer 37 on development roller 34 from being attracted to the surface of photosensitive drum 31, as illustrated in FIG. 10A and FIG. 10B, for example. As a result, the wasteful consumption of developer 37 can be reduced.

[Second Modification Example]

In a second modification example, development voltage table 160 and development voltage function 170 are respectively used instead of development voltage table 120 and development voltage function 130. Storage unit 107 stores therein development voltage table 160 and development voltage function 170 instead of development voltage table 120 and development voltage function 130. Storage unit 107 further stores therein threshold value $Tf_{th}$. Development voltage table 160 corresponds to a specific example of a "table" of the invention. Development voltage function 170 corresponds to a specific example of a "function" of the invention. Threshold value $T_{fth}$ corresponds to a specific example of a "second threshold value" of the invention.

In the second modification example, measurement unit 108 measures temperature $T_{60}$ of fixation unit 50 that fixes developer 37 onto medium PM. Temperature $T_{60}$ of fixation unit 50 is a parameter that decreases as stop time period $T_{off}$ increases. Medium PM corresponds to a specific example of a "medium" of the invention. Temperature $T_{60}$ of fixation unit 50 corresponds to a specific example of a "physical amount" of the invention. Measurement unit 108 is, for example, a temperature sensor. Measurement unit 108 starts the measurement of temperature $T_{60}$ of upper roller 51 or lower roller 52, for example, when detecting a control signal that is outputted from I/O port 102 and is used to stop the driving of motor 104 connected to photosensitive drum 31. Measurement unit 108 outputs measured temperature $T_{60}$ to controller 101. Measurement unit 108 further stops the measurement of temperature $T_{60}$ of upper roller 51 or lower roller 52, for example, when detecting a control signal that is outputted from I/O port 102 and is used to start the driving of motor 104 connected to photosensitive drum 31.

Figure 14:
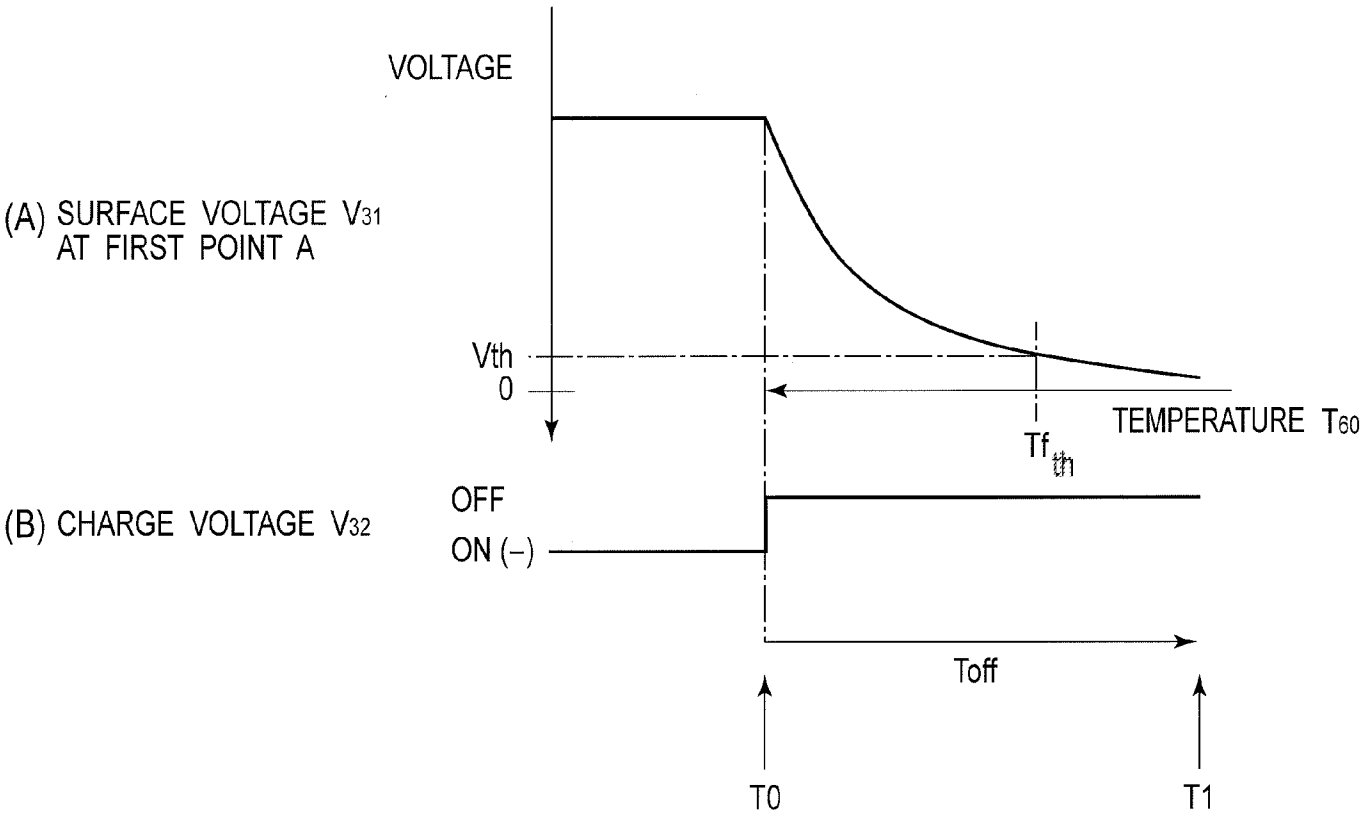
FIG. 14 shows waveform diagrams (A) and (B) illustrating examples of the voltage of the photosensitive drum and a charge roller.

Waveform (A) in FIG. 14A illustrates an example of time-dependent change in surface voltage $V_{31}$ at first point A of photosensitive drum 31. Waveform (B) in FIG. 14B illustrates an example of time-dependent change in charge voltage $V_{32}$. Note that, the horizontal axes in waveforms (A) and (B) in FIG. 14 indicate temperature $T_{60}$ of fixation unit 50 that is correlated with the time, instead of the time. The temperature of fixation unit 50 become lower toward the right side on the horizontal axes in waveform (A) and (B) in FIG. 14. The negative voltage becomes large toward the upper side on the longitudinal axis in waveform (A) in FIG. 14A.

Simultaneously with the stop of the rotation of photosensitive drum 31, charge voltage $V_{32}$ is cut off and becomes 0 volt. Surface voltage $V_{31}$ at first point A of photosensitive drum 31 is then attenuated with the elapse of time (with the decrease in temperature of fixation unit 50), and eventually becomes 0 volt or a voltage close to 0 volt. Development voltage table 160 and development voltage function 170 contain data obtained by the measurement or the prediction of such attenuation of surface voltage $V_3$.

FIG. 15A illustrates an example of development voltage table 160. FIG. 15B illustrates an example of development voltage function 170. Development voltage table 160 is a table in which development voltage $V_{34}$ is associated with temperature $T_{60}$ of fixation unit 50. In development voltage table 160, development voltage $V_{34}$ varies to Va, Va, Vb, . . . , Vb as temperature $T_{60}$ of fixation unit 50 varies to Tf1, Tf2, Tf3, . . . , Tfn. Development voltage function 170 is a function in which development voltage $V_{34}$ is associated with temperature $T_{60}$ of fixation unit 50. In development voltage function 170, development voltage $V_{34}$ varies to Va, Va, Vb, . . . , Vb as temperature $T_{60}$ of fixation unit 50 varies to Tf1, Tf2, Tf3, . . . , Tfn.

Herein, Va is a voltage higher than surface voltage $V_{31}$ and lower than 0 volt. Va is a voltage having a negative polarity, and includes negative polar data. Vb is a voltage higher than 0 volt. Vb is a voltage having a positive polarity, and includes positive polar data. Accordingly, development voltage table 160 is also a table in which the polarity of development voltage $V_{34}$ is associated with temperature $T_{60}$ of fixation unit 50. Moreover, development voltage function 170 is also a function in which the polarity of development voltage $V_{34}$ is associated with temperature $T_{60}$ of fixation unit 50.

Setting unit 109 sets the polarity of initial voltage Vi to be applied to development roller 34, based on temperature $T_{60}$ of fixation unit 50 measured by measurement unit 108. Setting unit 109 uses development voltage table 160 or development voltage function 170 that is read from storage unit 107 to obtain polar data corresponding to temperature $T_{60}$ of fixation unit 50 measured by measurement unit 108, and sets the obtained polar data as the polarity of initial voltage Vi. Moreover, setting unit 109 uses development voltage table 160 or development voltage function 170 that is read from storage unit 107 to obtain polar data and development voltage data corresponding to temperature $T_{60}$ of fixation unit 50 measured by measurement unit 108, and sets the polarity and a voltage value of initial voltage Vi based on the obtained polar data and development voltage data.

Setting unit 109 sets the polarity of initial voltage Vi to be negative when temperature $T_{60}$ of fixation unit 50 measured by measurement unit 108 is not less than threshold value $Tf_{th}$. Setting unit 109 sets the polarity of initial voltage Vi to be positive when temperature $T_{60}$ of fixation unit 50 measured by measurement unit 108 is less than threshold value $Tf_{th}$. Threshold value $T_{fth}$ is temperature $T_{60}$ of fixation unit 50 when the voltage of electrostatic latent image R2 on photosensitive drum 31 is at a predetermined value (threshold value $V_{th}$). Note that, threshold value $Tf_{th}$ corresponds to temperature Tf2, for example, in development voltage table 160 and development voltage function 170.

In the second modification example, in image formation apparatus 1, the polarity of initial voltage Vi to be applied to development roller 34 is set based on temperature $T_{60}$ of fixation unit 50. Specifically, the polarity corresponding to temperature $T_{60}$ of fixation unit 50 measured by measurement unit 108 is set as the polarity of initial voltage Vi, using development voltage table 160 or development voltage function 170 that is read from storage unit 107. If temperature $T_{60}$ of fixation unit 50 measured by measurement unit 108 is not less than threshold value $Tf_{th}$, the polarity of initial voltage Vi is set to be negative. If temperature $T_{60}$ of fixation unit 50 measured by measurement unit 108 is less than threshold value $Tf_{th}$, the polarity of initial voltage Vi is set to be positive. The polarity of initial voltage Vi is set in this manner in image formation apparatus 1 to prevent developer 37 on development roller 34 from being attracted to the surface of photosensitive drum 31, as illustrated in FIG. 10A and FIG. 10B, for example. As a result, the wasteful consumption of developer 37 can be reduced.

[Third Modification Example]

In a third modification example, polar table 180 and polar function 190 are used instead of development voltage table 120 and development voltage function 130, respectively. Storage unit 107 stores therein polar table 180 and polar function 190 instead of development voltage table 120 and development voltage function 130. Storage unit 107 further stores therein threshold value $Tf_{th}$. Polar table 180 corresponds to a specific example of a "table" of the invention. Polar function 190 corresponds to a specific example of a "function" of the invention. Threshold value $T_{fth}$ of the invention is a specific example of a "second threshold value".

FIG. 16A illustrates an example of polar table 180. FIG. 16B illustrates an example of polar function 190. Polar table 180 is a table in which polarity $P_{34}$ of development voltage $V_{34}$ is associated with temperature $T_{60}$ of fixation unit 50. In polar table 180, polarity $P_{34}$ of development voltage $V_{34}$ is minus (−) when temperature $T_{60}$ of fixation unit 50 is Tf1 and Tf2, and polarity $P_{34}$ of development voltage $V_{34}$ is plus (+) when temperature $T_{60}$ of fixation unit 50 is Tf3 to Tfn. Polar function 190 is a function in which polarity $P_{34}$ of development voltage $V_{34}$ is associated with temperature $T_{60}$ of fixation unit 50. In polar function 190, polarity $P_{34}$ of development voltage $V_{34}$ is minus (−) when temperature $T_{60}$ of fixation unit 50 is Tf1 and Tf2, and polarity $P_{34}$ of development voltage $V_{34}$ is plus (+) when temperature $T_{60}$ of fixation unit 50 is Tf3 to Tfn.

In the third modification example, setting unit 109 sets the polarity of initial voltage Vi to be applied to development roller 34, based on temperature $T_{60}$ of fixation unit 50 measured by measurement unit 108. Setting unit 109 uses polar table 180 or polar function 190 that is read from storage unit 107 to set polar data ($P_{34}$) corresponding to temperature $T_{60}$ of fixation unit 50 measured by measurement unit 108, as the polarity of initial voltage Vi. Setting unit 109 sets the polarity of initial voltage Vi to be negative when temperature $T_{60}$ of fixation unit 50 measured by measurement unit 108 is not less than threshold value $Tf_{th}$. Setting unit 109 sets the polarity of initial voltage Vi to be positive when temperature $T_{60}$ of fixation unit 50 measured by measurement unit 108 is less than threshold value $Tf_{th}$. In the modification example, threshold value $Tf_{th}$ is Tf2.

In the third modification example, in image formation apparatus 1, the polarity of initial voltage Vi to be applied to development roller 34 is set based on temperature $T_{60}$ of fixation unit 50. Specifically, the polarity corresponding to temperature $T_{60}$ of fixation unit 50 measured by measurement unit 108 is set as the polarity of initial voltage Vi, using polar table 180 or polar function 190 that is read from storage unit 107. If temperature $T_{60}$ of fixation unit 50 measured by measurement unit 108 is not less than threshold value $Tf_{th}$, the polarity of initial voltage Vi is set to be negative. If temperature $T_{60}$ of fixation unit 50 measured by measurement unit 108 is less than threshold value $Tf_{th}$, the polarity of initial voltage Vi is set to be positive. The polarity of initial voltage Vi is set in this manner in image formation apparatus 1 to prevent developer 37 on development roller 34 from being attracted to the surface of photosensitive drum 31, as illustrated in FIG. 10A and FIG. 10B, for example. As a result, the wasteful consumption of developer 37 can be reduced.

[Fourth Modification Example]

In a fourth modification example, development voltage table 210 and development voltage function 220 are used instead of development voltage table 120 and development voltage function 130, respectively. Storage unit 107 stores therein development voltage table 210 and development voltage function 220 instead of development voltage table 120 and development voltage function 130. Development voltage table 210 corresponds to a specific example of a "table" of the invention. Development voltage function 220 corresponds to a specific example of a "function" of the invention.

In the fourth modification example, measurement unit 108 measures surface voltage $V_{31}$ of photosensitive drum 31. Surface voltage $V_{31}$ of photosensitive drum 31 is a parameter that decreases as stop time period $T_{off}$ increases. Surface voltage $V_{31}$ of photosensitive drum 31 corresponds to a specific example of a "physical amount" of the invention. Measurement unit 108 is, for example, a voltmeter. Measurement unit 108 starts the measurement of surface voltage $V_{31}$ of photosensitive drum 31, for example, when detecting a control signal that is outputted from I/O port 102 and is used to stop the driving of motor 104 connected to photosensitive drum 31. Measurement unit 108 outputs measured surface voltage $V_{31}$ to controller 101. Measurement unit 108 further stops the measurement of surface voltage $V_{31}$ of photosensitive drum 31, for example, when detecting a control signal that is outputted from I/O port 102 and is used to start the driving of motor 104 connected to photosensitive drum 31.

FIG. 17A illustrates an example of development voltage table 210. FIG. 17B illustrates an example of development voltage function 220. Development voltage table 210 is a table in which development voltage $V_{34}$ is associated with surface voltage $V_{31}$. In development voltage table 210, development voltage $V_{34}$ varies to Va, Va, Vb, . . . , Vb as surface voltage $V_{31}$ of photosensitive drum 31 varies to V1, V2, V3, . . . , Vn. Development voltage function 220 is a function in which development voltage $V_{34}$ is associated with surface voltage $V_{31}$. In development voltage function 220, development voltage $V_{34}$ varies to Va, Va, Vb, . . . , Vb as surface voltage $V_{31}$ of photosensitive drum 31 varies to V1, V2, V3, . . . , Vn.

Herein, Va is a voltage higher than surface voltage $V_{31}$ and lower than 0 volt. Va is a voltage having a negative polarity, and includes negative polar data. Vb is a voltage higher than 0 volt. Vb is a voltage having a positive polarity, and includes positive polar data. Accordingly, development voltage table 210 is also a table in which the polarity of development voltage $V_{34}$ is associated with surface voltage $V_{31}$ of photosensitive drum 31. Moreover, development voltage function 220 is also a function in which the polarity of development voltage $V_{34}$ is associated with surface voltage $V_{31}$ of photosensitive drum 31.

Setting unit 109 sets the polarity of initial voltage Vi to be applied to development roller 34, based on surface voltage $V_{31}$ of photosensitive drum 31 measured by measurement unit 108. Setting unit 109 uses development voltage table 210 or development voltage function 220 that is read from storage unit 107 to obtain polar data corresponding to surface voltage $V_{31}$ of photosensitive drum 31 measured by measurement unit 108, and sets the obtained polar data as the polarity of initial voltage Vi. Moreover, setting unit 109 uses development voltage table 210 or development voltage function 220 that is read from storage unit 107 to obtain polar data and development voltage data corresponding to surface voltage $V_{31}$ of photosensitive drum 31 measured by measurement unit 108, and sets the polarity and a voltage value of initial voltage Vi based on the obtained polar data and development voltage data.

Setting unit 109 sets the polarity of initial voltage Vi to be negative when surface voltage $V_{31}$ of photosensitive drum 31 measured by measurement unit 108 is not less than threshold value $V_{th}$. Setting unit 109 sets the polarity of initial voltage Vi to be positive when surface voltage $V_{31}$ of photosensitive drum 31 measured by measurement unit 108 is less than threshold value $V_{th}$.

In the fourth modification example, in image formation apparatus 1, the polarity of initial voltage Vi to be applied to development roller 34 is set based on surface voltage $V_{31}$ of photosensitive drum 31. Specifically, the polarity corresponding to surface voltage $V_{31}$ of photosensitive drum 31 measured by measurement unit 108 is set as the polarity of initial voltage Vi, using development voltage table 210 or development voltage function 220 that is read from storage unit 107. If surface voltage $V_{31}$ of photosensitive drum 31 measured by measurement unit 108 is not less than threshold value $V_{th}$, the polarity of initial voltage Vi is set to be negative. If surface voltage $V_{31}$ of photosensitive drum 31 measured by measurement unit 108 is less than threshold value $V_{th}$, the polarity of initial voltage Vi is set to be positive. The polarity of initial voltage Vi is set in this manner in image formation apparatus 1 to prevent developer 37 on development roller 34 from being attracted to the surface of photosensitive drum 31, as illustrated in FIG. 10A and FIG. 10B, for example. As a result, the wasteful consumption of developer 37 can be reduced.

[Fifth Modification Example]

In the above-mentioned embodiment and the above-mentioned first to third modification examples, development voltage tables 120 and 160, development voltage functions 130 and 170, polar tables 140 and 180, and polar functions 150 and 190 may be provided in consideration of the environment (temperature or humidity) inside housing 100. In this case, measurement unit 108 is preferably configured to include a sensor that measures the temperature or the humidity.

The attenuation characteristic of surface voltage $V_{31}$ when the rotation of photosensitive drum 31 is stopped differs depending on the environment (temperature or humidity) inside housing 100, in a strict sense. Therefore, development voltage tables 120 and 160, development voltage functions 130 and 170, polar tables 140 and 180, and polar functions 150 and 190 preferably include parameters related to the environment (temperature or humidity) inside housing 100.

The attenuation characteristic of surface voltage $V_{31}$ when the rotation of photosensitive drum 31 is stopped has such a tendency that the attenuation amount becomes large at high temperature and high humidity, whereas the attenuation amount becomes small at low temperature and low humidity. In other words, the attenuation time of surface voltage $V_{31}$ is short at high temperature and high humidity, and is long at low temperature and low humidity.

Therefore, controller 101 preferably adjusts the above-mentioned parameters such that the polarity and the voltage value of initial voltage Vi at high temperature and high humidity have values adapted to the attenuation characteristic when the attenuation amount is large. Controller 101 preferably adjusts, for example, threshold value $T_{th}$ to a smaller value or threshold value $Tf_{th}$ to a higher value.

Moreover, controller 101 preferably adjusts the above-mentioned parameters such that the polarity and the voltage value of initial voltage Vi at low temperature and low humidity have values adapted to the attenuation characteristic when the attenuation amount is small. Controller 101 preferably adjusts, for example, threshold value $T_{th}$ to a larger value or threshold value $Tf_{th}$ to a lower value, at low temperature and low humidity.

In the modification examples, development voltage tables 120 and 160, development voltage functions 130 and 170, polar tables 140 and 180, and polar functions 150 and 190 are provided in consideration of the environment (temperature or humidity) inside housing 100. This allows the polarity and the voltage value of initial voltage Vi to be set in accordance with the environment (temperature or humidity) inside housing 100. As a result, even when the environment (temperature or humidity) inside housing 100 is changed, the wasteful consumption of developer 37 can be reduced.

[Sixth Modification Example]

The following describes various kinds of modification examples.

In the above-mentioned embodiment and the modification examples thereof, although an image is transferred by a direct method, an image may be transferred by an indirect method. Moreover, in the above-mentioned embodiment, a monochromatic image formation unit 30 is used. However, in the above-mentioned embodiment and the modification examples thereof, a multicolor image formation unit 30 may be used. Moreover, in the above-mentioned embodiment, LED head 33 is used. However, in the above-mentioned embodiment and the modification examples thereof, a laser element or the like may be used, instead of LED head 33 or together with LED head 33.

A series of processes described in the above-mentioned embodiment and the modification examples thereof may be implemented by hardware (circuit) or may be implemented by software (program). If the above-mentioned series of processes is implemented by software, the software is configured to include a group of programs causing a computer to execute the functions. The programs may be incorporated in the above-mentioned computer in advance, or may be installed in the above-mentioned computer from a network or a recording medium, for example.

In the above-mentioned embodiment and the modification examples thereof, a mode carrying out the invention is described using an electrophotographic printer as an example. However, the invention is not limited to the application to a color device or a printer, but can be applied to a typical image formation apparatus that forms an image on a conveyed medium. The invention can be applied to, for example, monochrome copiers, color copiers, monochrome MFPs, color MFPs, or the like.

In the above-mentioned embodiment, as a specific example of the "image formation apparatus" in the invention, an image formation apparatus having a printing function is described. However, the invention is not limited to the image formation apparatus having a printing function, but can be applied to an image formation apparatus that functions as a multifunction peripheral having a scanning function or a facsimile function, for example.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus comprising:

an image carrier including a peripheral surface with a photosensitive element;

a charge member placed facing the peripheral surface and configured to charge the peripheral surface;

an exposure unit that exposes with light a charged region of the peripheral surface charged by the charge member to form an electrostatic latent image;

a development member placed facing the peripheral surface at a position downstream of the charge member in a rotation direction of the image carrier, and configured to develop the electrostatic latent image with a developer;

a measurement unit that measures a stop time period when a rotation of the image carrier is being stopped, or a physical amount that varies as the stop time period increases;

a setting unit that sets a polarity of an initial voltage to be applied to the development member, the polarity determined based on the stop time period or the physical amount measured by the measurement unit; and a power source unit that applies the initial voltage with the polarity set by the setting unit to the development member, at rotation start time of the image carrier.

2. The image formation apparatus according to claim 1, further comprising a storage unit that stores therein a table or a function in which the polarity of the initial voltage to be applied to the development member is associated with the stop time period or the physical amount, wherein the setting unit obtains polar data corresponding to the stop time period or the physical amount measured by the measurement unit by using the table or the function read from the storage unit, and sets the obtained polar data as the polarity of the initial voltage.

3. The image formation apparatus according to claim 2, wherein the table is a table in which the polarity and a voltage value of the initial voltage to be applied to the development member are associated with the stop time period or the physical amount, and the setting unit obtains polar data and development voltage data corresponding to the stop time period or the physical amount measured by the measurement unit, by using the table read from the storage unit, and sets the polarity and the voltage value of the initial voltage based on the polar data and the development voltage data thus obtained.

4. The image formation apparatus according to claim 3, wherein, when setting the polarity of the initial voltage to be negative, the setting unit sets the voltage value of the initial voltage to a voltage value higher than a voltage value in the charged region.

5. The image formation apparatus according to claim 2, wherein the function is a function in which the polarity and a voltage value of the initial voltage to be applied to the development member are associated with the stop time period or the physical amount, and the setting unit obtains polar data and development voltage data corresponding to the stop time period or the physical amount measured by the measurement unit, by using the function read from the storage unit, and sets the polarity and the voltage value of the initial voltage based on the polar data and the development voltage data thus obtained.

6. The image formation apparatus according to claim 1, wherein the setting unit sets the polarity of the initial voltage to be negative when the stop time period measured by the measurement unit is not more than a first threshold value, and sets the polarity of the initial voltage to be positive when the stop time period measured by the measurement unit is more than the first threshold value.

7. The image formation apparatus according to claim 1, wherein the physical amount is a parameter that decreases as the stop time period increases, and the setting unit sets the polarity of the initial voltage to be negative when the physical amount measured by the measurement unit is not less than a second threshold value, and sets the polarity of the initial voltage to be positive when the physical amount measured by the measurement unit is less than the second threshold value.

8. The image formation apparatus according to claim 1, wherein the power source unit applies the initial voltage with the polarity set by the setting unit to the development member within a period from the rotation start time to transfer start time of a developer image formed by a development by the development member.

9. The image formation apparatus according to claim 8, wherein, when the polarity of the initial voltage set by the setting unit is negative, the power source unit applies the initial voltage with a certain voltage value to the development member, the certain voltage value being equal to a voltage value of a voltage to be applied to the development member during printing.

10. The image formation apparatus according to claim 1, wherein the physical amount is a temperature of a fixation unit that fixes the developer onto a medium.

11. The image formation apparatus according to claim 1, wherein the physical amount is a surface voltage of the image carrier.

* * * * *